US009187962B2

(12) United States Patent
Burhan et al.

(10) Patent No.: US 9,187,962 B2
(45) Date of Patent: Nov. 17, 2015

(54) METHODS OF ATTACHING ROLLING CUTTERS IN FIXED CUTTER BITS USING SLEEVE, COMPRESSION SPRING, AND/OR PIN(S)/BALL(S)

(75) Inventors: Yuri Burhan, Spring, TX (US); Jiaqing Yu, Conroe, TX (US); Jonan M. Fulenchek, Tomball, TX (US); Youhe Zhang, Spring, TX (US); Yuelin Shen, Spring, TX (US)

(73) Assignee: Smith International, Inc., Houston, TX (US)

( * ) Notice: Subject to any disclaimer, the term of this patent is extended or adjusted under 35 U.S.C. 154(b) by 768 days.

(21) Appl. No.: 13/456,624

(22) Filed: Apr. 26, 2012

(65) Prior Publication Data

US 2012/0273281 A1 Nov. 1, 2012

Related U.S. Application Data

(60) Provisional application No. 61/479,151, filed on Apr. 26, 2011, provisional application No. 61/556,454, filed on Nov. 7, 2011.

(51) Int. Cl.

| | |
|---|---|
| ***E21B 10/36*** | (2006.01) |
| ***B21K 5/04*** | (2006.01) |
| ***E21B 10/633*** | (2006.01) |

(Continued)

(52) U.S. Cl.

CPC ..... *E21B 10/633* (2013.01); *E21B 10/54* (2013.01); *E21B 10/573* (2013.01)

(58) Field of Classification Search

CPC ..... E21B 10/567; E21B 10/54; E21B 10/573; E21B 10/633; E21B 10/627; E21B 10/5735

USPC ..... 175/432, 426, 430, 434

See application file for complete search history.

(56) References Cited

U.S. PATENT DOCUMENTS

| | | | | |
|---|---|---|---|---|
| 1,723,381 | A * | 8/1929 | Seifert | 175/334 |
| 1,790,613 | A * | 1/1931 | Gildersleeve et al. | 175/348 |

(Continued)

FOREIGN PATENT DOCUMENTS

| | | | |
|---|---|---|---|
| CN | 101525982 | A | 9/2009 |
| EP | 219959 | A2 | 4/1987 |

(Continued)

OTHER PUBLICATIONS

Clayton, et al., "New Bit Design, Cutter Technology Extend PDC Applications to Hard Rock Drilling", SPE 91840—SPE/IADC Drilling Conference, Amsterdam, Netherlands, Feb. 23-25, 2005, 9 pages.

(Continued)

*Primary Examiner* — Daniel P Stephenson

(57) ABSTRACT

A cutting element has a sleeve with a first inner diameter and a second inner diameter, where the second inner diameter is larger than the first inner diameter and located at a lower axial position than the first inner diameter. A rotatable cutting element having an axis of rotation extending therethrough is at least partially disposed within the sleeve. The rotatable cutting element has a cutting face and a body extending axially downward from the cutting face, at least one hole extending from an outer surface of the body toward the axis of rotation, and a locking device disposed in each hole. The locking device protrudes from the hole to contact the second inner diameter of the sleeve, thereby retaining the rotatable cutting element within the sleeve.

26 Claims, 14 Drawing Sheets

(51) Int. Cl.
*E21B 10/54* (2006.01)
*E21B 10/573* (2006.01)

(56) References Cited

U.S. PATENT DOCUMENTS

| | | | | |
|---|---|---|---|---|
| 3,442,342 | A | 5/1969 | Cunningham et al. | |
| 3,581,835 | A | 6/1971 | Stebley | |
| 3,788,409 | A | 1/1974 | Curington | |
| 3,970,158 | A | 7/1976 | Black et al. | |
| 4,026,605 | A | 5/1977 | Emmerich | |
| 4,047,583 | A | 9/1977 | Dyer | |
| 4,104,344 | A | 8/1978 | Pope et al. | |
| 4,108,260 | A | 8/1978 | Bozarth | |
| 4,181,187 | A | 1/1980 | Lumen | |
| 4,199,035 | A * | 4/1980 | Thompson | 175/432 |
| 4,200,159 | A * | 4/1980 | Peschel et al. | 175/428 |
| 4,222,446 | A * | 9/1980 | Vasek | 299/110 |
| 4,288,248 | A | 9/1981 | Bovenkerk et al. | |
| 4,323,130 | A | 4/1982 | Dennis | |
| 4,334,585 | A | 6/1982 | Upton | |
| 4,350,215 | A * | 9/1982 | Radtke | 175/433 |
| 4,381,825 | A | 5/1983 | Radtke | |
| 4,396,077 | A | 8/1983 | Radtke | |
| 4,442,909 | A | 4/1984 | Radtke | |
| 4,478,297 | A | 10/1984 | Radtke | |
| 4,494,618 | A | 1/1985 | Radtke | |
| 4,505,342 | A | 3/1985 | Barr et al. | |
| 4,511,006 | A * | 4/1985 | Grainger | 175/57 |
| 4,529,048 | A | 7/1985 | Hall | |
| 4,553,615 | A | 11/1985 | Grainger | |
| 4,570,725 | A | 2/1986 | Matthias et al. | |
| 4,593,776 | A | 6/1986 | Salesky et al. | |
| 4,597,456 | A | 7/1986 | Ecer | |
| 4,604,106 | A | 8/1986 | Hall | |
| 4,605,157 | A | 8/1986 | Barr et al. | |
| 4,632,196 | A | 12/1986 | Dennis | |
| 4,654,947 | A * | 4/1987 | Davis | 29/402.08 |
| 4,722,405 | A | 2/1988 | Langford, Jr. | |
| 4,724,913 | A | 2/1988 | Morris | |
| 4,751,972 | A | 6/1988 | Jones et al. | |
| 4,756,631 | A * | 7/1988 | Jones | 384/95 |
| 4,767,050 | A | 8/1988 | Flood et al. | |
| 4,811,801 | A | 3/1989 | Salesky et al. | |
| 4,813,501 | A * | 3/1989 | Mills et al. | 175/335 |
| 4,821,819 | A | 4/1989 | Whysong | |
| 4,832,139 | A | 5/1989 | Minikus et al. | |
| 4,887,493 | A | 12/1989 | Drake | |
| 4,981,184 | A | 1/1991 | Knowlton et al. | |
| 5,025,874 | A | 6/1991 | Barr et al. | |
| 5,040,623 | A * | 8/1991 | Vezirian | 175/354 |
| 5,060,739 | A | 10/1991 | Griffin | |
| 5,061,293 | A | 10/1991 | Barr et al. | |
| 5,119,714 | A | 6/1992 | Scott et al. | |
| 5,127,923 | A | 7/1992 | Bunting et al. | |
| 5,159,857 | A | 11/1992 | Jurewicz | |
| 5,161,627 | A | 11/1992 | Burkett | |
| 5,172,779 | A | 12/1992 | Siracki et al. | |
| 5,285,859 | A | 2/1994 | Tibbitts | |
| 5,287,936 | A | 2/1994 | Grimes et al. | |
| 5,323,865 | A | 6/1994 | Isbell et al. | |
| 5,351,768 | A | 10/1994 | Scott et al. | |
| 5,379,853 | A | 1/1995 | Lockwood et al. | |
| 5,415,244 | A | 5/1995 | Portwood | |
| 5,431,239 | A | 7/1995 | Tibbitts et al. | |
| 5,460,233 | A | 10/1995 | Meany et al. | |
| 5,467,669 | A | 11/1995 | Stroud | |
| 5,484,191 | A | 1/1996 | Sollami | |
| 5,535,839 | A | 7/1996 | Brady | |
| 5,649,604 | A | 7/1997 | Fuller et al. | |
| 5,678,645 | A | 10/1997 | Tibbitts et al. | |
| 5,697,462 | A | 12/1997 | Grimes et al. | |
| 5,709,278 | A | 1/1998 | Crawford | |
| 5,722,497 | A | 3/1998 | Gum et al. | |
| 5,740,874 | A | 4/1998 | Matthias | |
| 5,752,573 | A | 5/1998 | Scott et al. | |
| 5,803,196 | A | 9/1998 | Fielder | |
| 5,881,828 | A | 3/1999 | Fischer et al. | |
| 5,887,580 | A | 3/1999 | Eyre | |
| 5,979,579 | A | 11/1999 | Jurewicz | |
| 6,029,759 | A | 2/2000 | Sue et al. | |
| 6,065,552 | A | 5/2000 | Scott et al. | |
| 6,065,554 | A * | 5/2000 | Taylor et al. | 175/430 |
| 6,116,359 | A | 9/2000 | Prejean | |
| 6,142,250 | A | 11/2000 | Griffin et al. | |
| 6,145,605 | A | 11/2000 | Karlsson | |
| 6,199,645 | B1 | 3/2001 | Anderson et al. | |
| 6,220,376 | B1 | 4/2001 | Lundell | |
| 6,227,318 | B1 | 5/2001 | Siracki | |
| 6,241,035 | B1 | 6/2001 | Portwood | |
| 6,244,365 | B1 | 6/2001 | Southland | |
| 6,290,008 | B1 | 9/2001 | Portwood et al. | |
| 6,371,225 | B1 | 4/2002 | Overstreet et al. | |
| 6,394,199 | B1 | 5/2002 | Skyles et al. | |
| 6,443,246 | B1 | 9/2002 | Pessier et al. | |
| 6,488,106 | B1 | 12/2002 | Dourfaye | |
| 6,604,588 | B2 | 8/2003 | Eyre et al. | |
| 7,559,695 | B2 | 7/2009 | Sexton et al. | |
| 7,703,559 | B2 * | 4/2010 | Shen et al. | 175/432 |
| 7,762,359 | B1 * | 7/2010 | Miess | 175/432 |
| 8,091,655 | B2 * | 1/2012 | Shen et al. | 175/432 |
| 8,413,746 | B2 * | 4/2013 | Shen et al. | 175/432 |
| 8,727,043 | B2 * | 5/2014 | Zhang et al. | 175/428 |
| 2002/0000336 | A1 | 1/2002 | Claesson et al. | |
| 2002/0084112 | A1 | 7/2002 | Hall et al. | |
| 2002/0100620 | A1 | 8/2002 | Singh et al. | |
| 2002/0108790 | A1 | 8/2002 | Eyre et al. | |
| 2002/0144843 | A1 * | 10/2002 | Mensa-Wilmot et al. | 175/331 |
| 2004/0026983 | A1 | 2/2004 | McAlvain | |
| 2004/0065484 | A1 | 4/2004 | McAlvain | |
| 2004/0094334 | A1 | 5/2004 | Singh | |
| 2004/0108145 | A1 | 6/2004 | Siracki | |
| 2004/0149493 | A1 | 8/2004 | McDonough | |
| 2005/0211474 | A1 | 9/2005 | Nguyen et al. | |
| 2005/0257963 | A1 | 11/2005 | Tucker et al. | |
| 2005/0263327 | A1 | 12/2005 | Meiners et al. | |
| 2006/0157286 | A1 | 7/2006 | Pope | |
| 2007/0000699 | A1 | 1/2007 | Viswanadham et al. | |
| 2007/0079991 | A1 * | 4/2007 | Cooley et al. | 175/57 |
| 2007/0084640 | A1 | 4/2007 | Singh | |
| 2007/0125579 | A1 | 6/2007 | Chen et al. | |
| 2007/0151769 | A1 | 7/2007 | Slutz et al. | |
| 2007/0199739 | A1 | 8/2007 | Schwefe et al. | |
| 2007/0278015 | A1 | 12/2007 | Boudrare et al. | |
| 2007/0278017 | A1 | 12/2007 | Shen et al. | |
| 2008/0035384 | A1 | 2/2008 | Simmons et al. | |
| 2008/0041993 | A1 | 2/2008 | Hall et al. | |
| 2008/0053710 | A1 | 3/2008 | Moss | |
| 2008/0121746 | A1 | 5/2008 | Hall et al. | |
| 2008/0156542 | A1 | 7/2008 | Baker et al. | |
| 2008/0156544 | A1 | 7/2008 | Singh et al. | |
| 2008/0164069 | A1 | 7/2008 | McDonough et al. | |
| 2008/0190666 | A1 | 8/2008 | Gatell | |
| 2008/0251293 | A1 * | 10/2008 | Mumma et al. | 175/57 |
| 2008/0264696 | A1 | 10/2008 | Dourfaye et al. | |
| 2008/0308320 | A1 | 12/2008 | Kolachalam | |
| 2009/0020339 | A1 * | 1/2009 | Sherwood, Jr. | 175/426 |
| 2009/0178856 | A1 | 7/2009 | Singh et al. | |
| 2009/0229887 | A1 | 9/2009 | Tedeschi | |
| 2010/0126775 | A1 | 5/2010 | Crawford et al. | |
| 2010/0212964 | A1 | 8/2010 | Beuershausen et al. | |
| 2010/0219001 | A1 * | 9/2010 | Shen et al. | 175/432 |
| 2010/0314176 | A1 | 12/2010 | Zhang et al. | |
| 2011/0284293 | A1 | 11/2011 | Shen et al. | |
| 2011/0297454 | A1 | 12/2011 | Shen et al. | |
| 2012/0073881 | A1 * | 3/2012 | Shen et al. | 175/428 |
| 2012/0273281 | A1 * | 11/2012 | Burhan et al. | 175/431 |
| 2013/0146367 | A1 * | 6/2013 | Zhang et al. | 175/374 |
| 2014/0054094 | A1 * | 2/2014 | Burhan et al. | 175/354 |

FOREIGN PATENT DOCUMENTS

| | | | |
|---|---|---|---|
| EP | 291314 | A2 | 11/1988 |
| EP | 353214 | A2 | 1/1990 |
| EP | 601840 | A1 | 6/1994 |

(56) References Cited

FOREIGN PATENT DOCUMENTS

| | | | |
|---|---|---|---|
| EP | 579662 | B1 | 12/1996 |
| EP | 916804 | A1 | 5/1999 |
| GB | 2216577 | A | 10/1989 |
| GB | 2240797 | A | 8/1991 |
| GB | 2275690 | A | 9/1994 |

OTHER PUBLICATIONS

Feenstra, R., "Status of Polycrystalline-Diamond-Compact Bits: Part I Development", Journal of Petroleum Technology, vol. 40 (6), Jun. 1988, pp. 675-684.

Kerr, et al., "PDC Drill Bit Design and Field Application Evolution", Journal of Petroleum Technology, vol. 40 (3), Mar. 1988, pp. 327-332.

Keshavan, et al., "Diamond-Enhanced Insert: New Compositions and Shapes for Drilling Soft-to-Hard Formations", SPE 25737—SPE/IADC Drilling Conference, Amsterdam, Netherlands, Feb. 22-25, 1993, 15 pages.

Sinor, et al., "The Effect of PDC Cutter Density, Back Rake, Size, and Speed on Performance", SPE 39306—IADC/SPE Drilling Conference, Dallas, Texas, Mar. 3-6, 1998, 9 pages.

Tran, Mark , "New PDC bit designs continue to impove", World Oil, vol. 229 (11), 2008, pp. 97-106.

International Search Report and Written Opinion issued in PCT/US2012/035140 on Jan. 14, 2013, 14 pages.

First Office Action issued in CN201280031690.6 on Jan. 30, 2015, 25 pages.

* cited by examiner

METHODS OF ATTACHING ROLLING CUTTERS IN FIXED CUTTER BITS USING SLEEVE, COMPRESSION SPRING, AND/OR PIN(S)/BALL(S)

CROSS-REFERENCE TO RELATED APPLICATIONS

This Application claims the benefit of U.S. Provisional Application No. 61/479,151 filed on Apr. 26, 2011, and U.S. Provisional Application No. 61/556,454 filed on Nov. 7, 2011, which are herein incorporated by reference in their entirety.

BACKGROUND

Drill bits used to drill wellbores through earth formations generally are made within one of two broad categories of bit structures. Depending on the application/formation to be drilled, the appropriate type of drill bit may be selected based on the cutting action type for the bit and its appropriateness for use in the particular formation. Drill bits in the first category are generally known as "roller cone" bits, which include a bit body having one or more roller cones rotatably mounted to the bit body. The bit body is typically formed from steel or another high strength material. The roller cones are also typically formed from steel or other high strength material and include a plurality of cutting elements disposed at selected positions about the cones. The cutting elements may be formed from the same base material as is the cone. These bits are typically referred to as "milled tooth" bits. Other roller cone bits include "insert" cutting elements that are press (interference) fit into holes formed and/or machined into the roller cones. The inserts may be formed from, for example, tungsten carbide, natural or synthetic diamond, boron nitride, or any one or combination of hard or superhard materials.

Drill bits of the second category are typically referred to as "fixed cutter" or "drag" bits. Drag bits, include bits that have cutting elements attached to the bit body, which may be a steel bit body or a matrix bit body formed from a matrix material such as tungsten carbide surrounded by a binder material. Drag bits may generally be defined as bits that have no moving parts. However, there are different types and methods of forming drag bits that are known in the art. For example, drag bits having abrasive material, such as diamond, impregnated into the surface of the material which forms the bit body are commonly referred to as "impreg" bits. Drag bits having cutting elements made of an ultra hard cutting surface layer or "table" (typically made of polycrystalline diamond material or polycrystalline boron nitride material) deposited onto or otherwise bonded to a substrate are known in the art as polycrystalline diamond compact ("PDC") bits.

PDC bits drill soft formations easily, but they are frequently used to drill moderately hard or abrasive formations. They cut rock formations with a shearing action using small cutters that do not penetrate deeply into the formation. Because the penetration depth is shallow, high rates of penetration are achieved through relatively high bit rotational velocities.

PDC cutters have been used in industrial applications including rock drilling and metal machining for many years. In PDC bits, PDC cutters are received within cutter pockets, which are formed within blades extending from a bit body, and are typically bonded to the blades by brazing to the inner surfaces of the cutter pockets. The PDC cutters are positioned along the leading edges of the bit body blades so that as the bit body is rotated, the PDC cutters engage and drill the earth formation. In use, high forces may be exerted on the PDC cutters, particularly in the forward-to-rear direction. Additionally, the bit and the PDC cutters may be subjected to substantial abrasive forces. In some instances, impact, vibration, and erosive forces have caused drill bit failure due to loss of one or more cutters, or due to breakage of the blades.

In a typical PDC cutter, a compact of polycrystalline diamond ("PCD") (or other superhard material, such as polycrystalline cubic boron nitride) is bonded to a substrate material, which is typically a sintered metal-carbide to form a cutting structure. PCD comprises a polycrystalline mass of diamond grains or crystals that are bonded together to form an integral, tough, high-strength mass or lattice. The resulting PCD structure produces enhanced properties of wear resistance and hardness, making PCD materials extremely useful in aggressive wear and cutting applications where high levels of wear resistance and hardness are desired.

An example of a prior art PDC bit having a plurality of cutters with ultra hard working surfaces is shown in FIGS. 1A and 1B. The drill bit 100 includes a bit body 110 having a threaded upper pin end 111 and a cutting end 115. The cutting end 115 typically includes a plurality of ribs or blades 120 arranged about the rotational axis L (also referred to as the longitudinal or central axis) of the drill bit and extending radially outward from the bit body 110. Cutting elements, or cutters, 150 are embedded in the blades 120 at predetermined angular orientations and radial locations relative to a working surface and with a desired back rake angle and side rake angle against a formation to be drilled.

A plurality of orifices 116 are positioned on the bit body 110 in the areas between the blades 120, which may be referred to as "gaps" or "fluid courses." The orifices 116 are commonly adapted to accept nozzles. The orifices 116 allow drilling fluid to be discharged through the bit in selected directions and at selected rates of flow between the blades 120 for lubricating and cooling the drill bit 100, the blades 120 and the cutters 150. The drilling fluid also cleans and removes the cuttings as the drill bit 100 rotates and penetrates the geological formation. Without proper flow characteristics, insufficient cooling of the cutters 150 may result in cutter failure during drilling operations. The fluid courses are positioned to provide additional flow channels for drilling fluid and to provide a passage for formation cuttings to travel past the drill bit 100 toward the surface of a wellbore (not shown).

Referring to FIG. 1B, a top view of a prior art PDC bit is shown. The cutting face 118 of the bit shown includes a plurality of blades 120, wherein each blade has a leading side 122 facing the direction of bit rotation, a trailing side 124 (opposite from the leading side), and a top side 126. Each blade includes a plurality of cutting elements or cutters generally disposed radially from the center of cutting face 118 to generally form rows. Certain cutters, although at differing axial positions, may occupy radial positions that are in similar radial position to other cutters on other blades.

A significant factor in determining the longevity of PDC cutters is the exposure of the cutter to heat. Exposure to heat can cause thermal damage to the diamond table and eventually result in the formation of cracks (due to differences in thermal expansion coefficients) which can lead to spalling of the polycrystalline diamond layer, delamination between the polycrystalline diamond and substrate, and conversion of the diamond back into graphite causing rapid abrasive wear. The thermal operating range of conventional PDC cutters is typically 700-750° C. or less.

As mentioned, conventional polycrystalline diamond is stable at temperatures of up to 700-750° C. in air, above which observed increases in temperature may result in permanent damage to and structural failure of polycrystalline diamond. This deterioration in polycrystalline diamond is due to the significant difference in the coefficient of thermal expansion of the binder material, cobalt, as compared to diamond. Upon heating of polycrystalline diamond, the cobalt and the diamond lattice will expand at different rates, which may cause cracks to form in the diamond lattice structure and result in deterioration of the polycrystalline diamond. Damage may also be due to graphite formation at diamond-diamond necks leading to loss of microstructural integrity and strength loss, at extremely high temperatures.

In convention drag bits, PDC cutters are fixed onto the surface of the bit such that a common cutting surface contacts the formation during drilling. Over time and/or when drilling certain hard but not necessarily highly abrasive rock formations, the edge of the working surface on a cutting element that constantly contacts the formation begins to wear down, forming a local wear flat, or an area worn disproportionately to the remainder of the cutting element. Local wear flats may result in longer drilling times due to a reduced ability of the drill bit to effectively penetrate the work material and a loss of rate of penetration caused by dulling of edge of the cutting element. That is, the worn PDC cutter acts as a friction bearing surface that generates heat, which accelerates the wear of the PDC cutter and slows the penetration rate of the drill. Such flat surfaces effectively stop or severely reduce the rate of formation cutting because the conventional PDC cutters are not able to adequately engage and efficiently remove the formation material from the area of contact. Additionally, the cutters are typically under constant thermal and mechanical load. As a result, heat builds up along the cutting surface, and results in cutting element fracture. When a cutting element breaks, the drilling operation may sustain a loss of rate of penetration, and additional damage to other cutting elements, should the broken cutting element contact a second cutting element.

Additionally, the generation of heat at the cutter contact point, specifically at the exposed part of the PDC layer caused by friction between the PCD and the work material, causes thermal damage to the PCD in the form of cracks which lead to spalling of the polycrystalline diamond layer, delamination between the polycrystalline diamond and substrate, and back conversion of the diamond to graphite causing rapid abrasive wear. The thermal operating range of conventional PDC cutters is typically 750° C. or less.

Accordingly, there exists a continuing need for developments in improving the life of cutting elements.

SUMMARY

In one aspect, embodiments of the present disclosure relate to a cutting element having a sleeve with a first inner diameter, and a second inner diameter, wherein the second inner diameter is larger than the first inner diameter and located at a lower axial position than the first inner diameter, a rotatable cutting element having an axis of rotation extending therethrough, the rotatable cutting element at least partially disposed within the sleeve, wherein the rotatable cutting element has a cutting face and a body extending axially downward from the cutting face, at least one hole extending from an outer surface of the body toward the axis of rotation, and a locking device disposed in each hole, wherein the locking device protrudes from the hole to contact the second inner diameter of the sleeve, thereby retaining the rotatable cutting element within the sleeve.

In another aspect, embodiments of the present disclosure relate to a method of forming a drill bit that includes providing a drill bit having a bit body, a plurality of blades extending from the bit body, and a plurality of cutter pockets disposed in the plurality of blades, attaching a sleeve to at least one cutter pocket, the sleeve comprising a first inner diameter and a second inner diameter, wherein the second inner diameter is larger than the first inner diameter and is located at a lower axial position than the first inner diameter, inserting a rotatable cutting element having an axis of rotation extending therethrough into the sleeve, the rotatable cutting element comprising a cutting face and a body extending axially downward from the cutting face, at least one hole extending from an outer surface of the body toward the axis of rotation, and a locking device disposed in each hole, wherein the locking device protrudes from the hole to contact the second inner diameter of the sleeve, thereby retaining the rotatable cutting element within the sleeve.

In another aspect, embodiments disclosed herein relate to a cutting element having a sleeve comprising an inner radius of a lesser value at an upper region of the sleeve than at a lower region of the sleeve, a rotatable cutting element having an axis of rotation extending therethrough, the rotatable cutting element at least partially disposed within the sleeve, wherein the rotatable cutting element has a diamond cutting face adjacent the uppermost portion of the sleeve, wherein at least a portion of the rotatable cutting element has an outer radius greater than the inner radius of the upper region of the sleeve, and wherein the portion of the rotatable cutting element is at a lower longitudinal position than the inner radius.

In yet another aspect, embodiments disclosed herein relate to a cutting element having an inner support member with a longitudinal axis extending therethrough, at least one hole extending from an outer surface of the inner support member toward the longitudinal axis, and a locking device disposed in each hole, a rotatable sleeve cutting element rotatably mounted to the inner support member, the rotatable sleeve cutting element having a cutting face adjacent the uppermost portion of the rotatable sleeve cutting element and a circumferential groove formed within an inner surface of the rotatable sleeve cutting element, wherein the locking device protrudes from the hole to contact the circumferential groove, thereby retaining the rotatable sleeve cutting element to the inner support member.

Other aspects and advantages of the disclosure will be apparent from the following description and the appended claims.

DETAILED DESCRIPTION

Embodiments disclosed herein relate generally to rotatable cutting elements and methods of retaining such rotatable cutting elements on a drill bit or other cutting tools. In particular, rotatable cutting elements of the present disclosure may be retained on fixed cutter drill bits using an adjustable locking device and/or a sleeve having multiple radii. Advantageously, adjustable locking devices and the sleeves described herein allow a rotatable cutting element to rotate as the rotatable cutting element contacts the formation to be drilled, while at the same time retaining the rotatable cutting element on the drill bit.

Figure 1A:
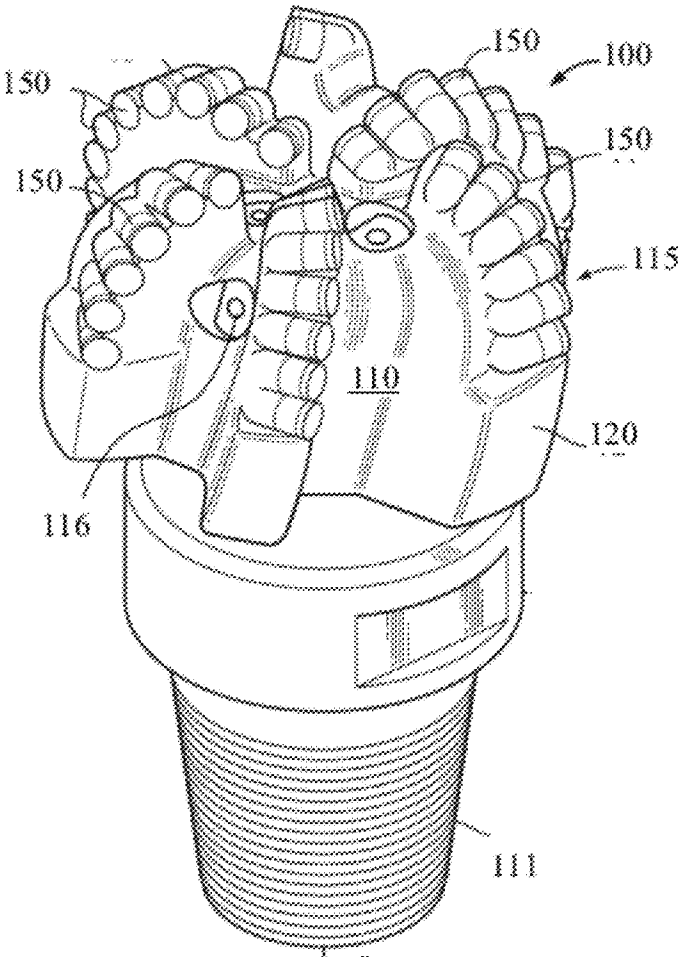
FIG. 1A (Prior Art)
FIGS. 1A and 1B show a side and top view of a conventional drag bit.
Figure 1B:
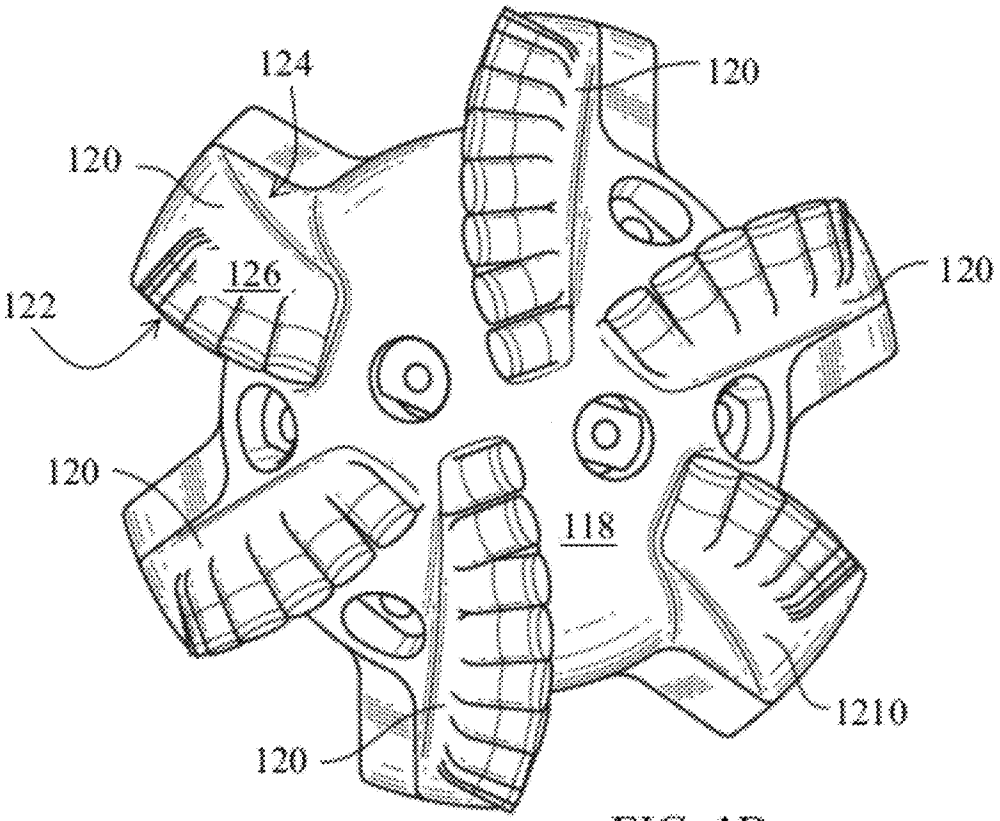
FIG. 1B (Prior Art)
Figure 2A:
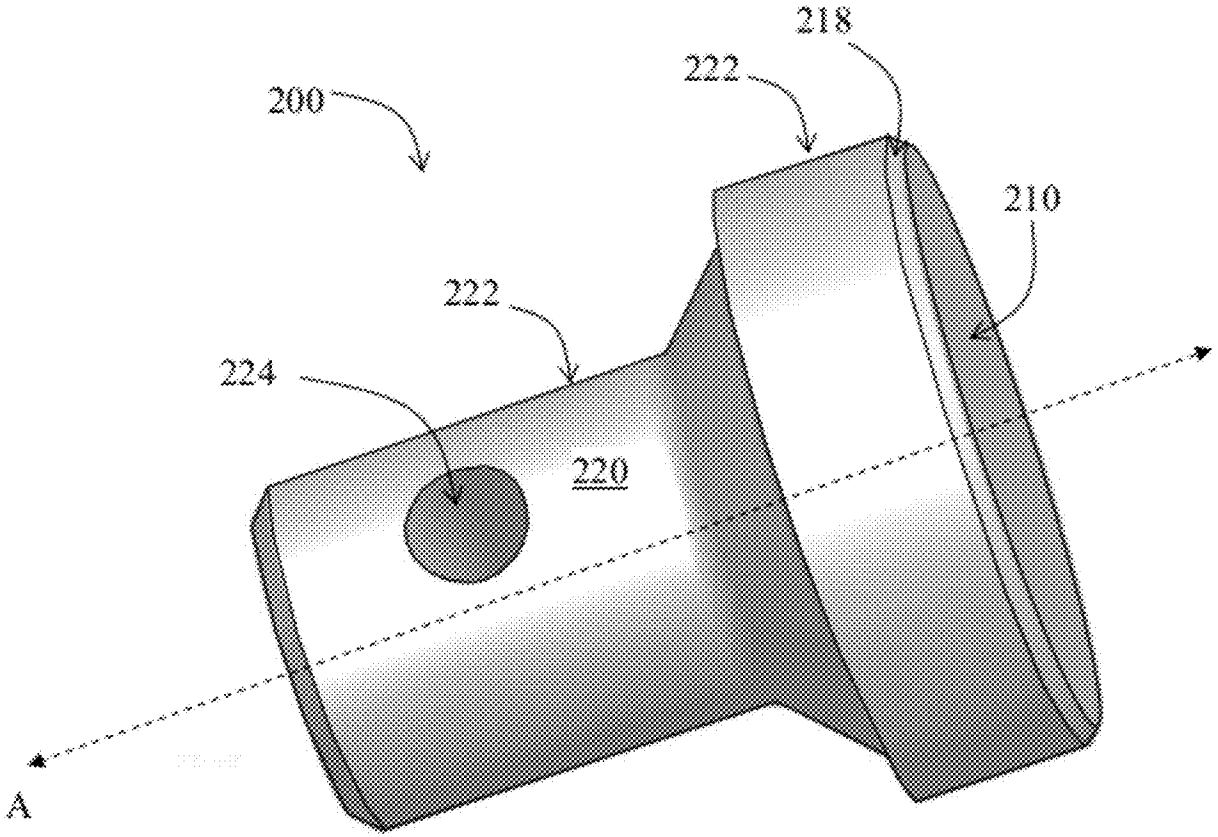
FIGS. 2A and 2B show perspective views of a rotatable cutting element of the present disclosure.
Figure 2B:
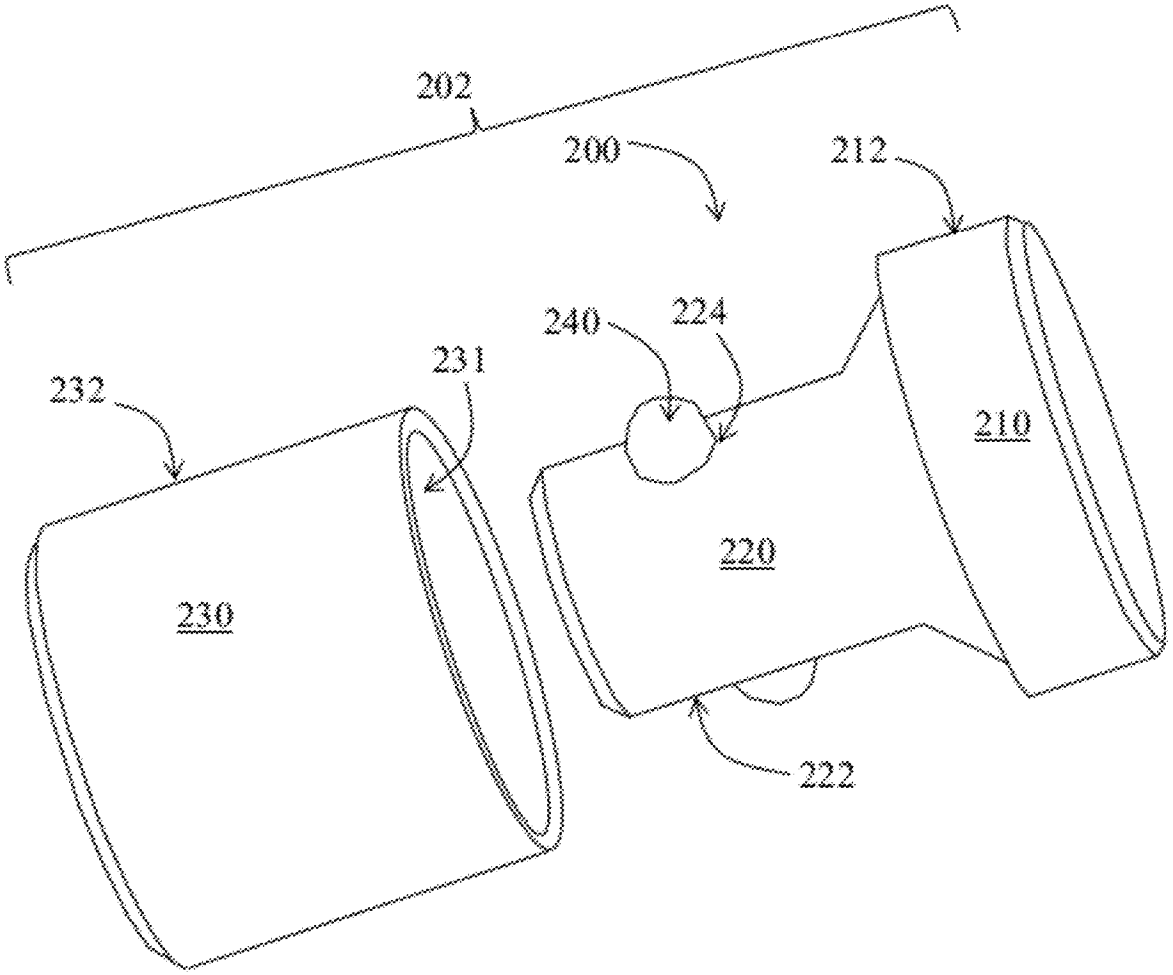

FIGS. 2A and 2B show an exemplary embodiment of a rotatable cutting element assembly according to the present disclosure. As shown in FIG. 2A, a rotatable cutting element 200 has an axis of rotation A extending longitudinally through the rotatable cutting element 200, a cutting face 210, and a body 220 extending axially downward from the cutting face 210. The body 220 has an outer surface 222 and at least one hole 224 extending from the outer surface 222 of the body 220 toward the axis of rotation A. A cutting edge 218 is formed at the intersection of the cutting face 210 and the outer surface 222 of the rotatable cutting element 200.

As shown in FIG. 2B, the body 220 of the rotatable cutting element 200 may be disposed in a sleeve 230 to form a cutter assembly 202, wherein the sleeve 230 has an inner surface 231, an outer surface 232, and multiple inner radii (not shown). A locking device 240 (effectively increasing the diameter of a portion of the rotatable cutting element 200) is disposed in the at least one hole 224, wherein the locking device 240 may protrude from the hole 224 to contact the inner surface 231 of the sleeve 230 to retain the rotatable cutting element 200 in the sleeve 230. Locking devices of the present disclosure may be made of carbides, steels, ceramics, and/or hardened tool steel, for example.

Figure 3A:
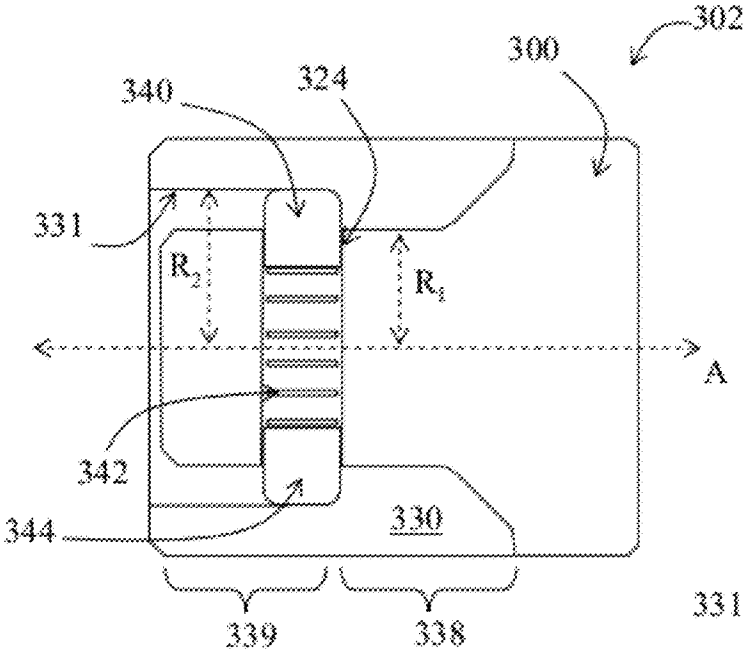
FIGS. 3A and 3B show cross-sectional views of rotatable cutting elements according to embodiments of the present disclosure.
Figure 3B:
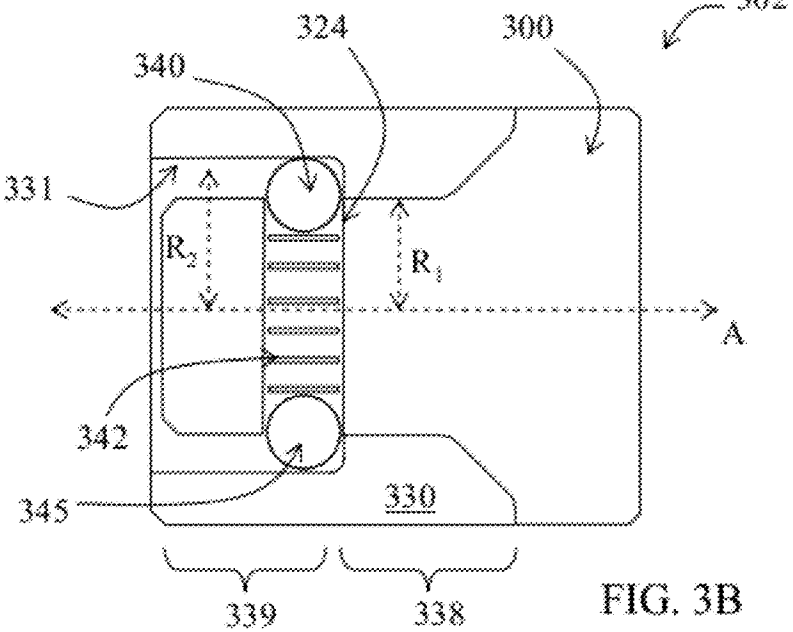

FIGS. 3A and 3B show cross-sectional views of exemplary embodiments of adjustable locking devices 340 retaining a rotatable cutting element 300 within a sleeve 330 to form a cutter assembly 302. The sleeve 330 has an outer surface 332, an inner surface 331, and multiple inner radii, including an inner radius $R_1$ of a lesser value at an upper region 338 of the sleeve than an inner radius $R_2$ at a lower region 339 of the sleeve, wherein the inner surface radii are measured from the axis of rotation A of the rotatable cutting element 300. The locking device 340 protrudes from the hole 324 to contact the inner surface 331 of the sleeve 330 at the larger inner radius $R_2$, wherein the smaller inner radius $R_1$ prevents the locking device 340 from moving out of the sleeve 330, thus retaining the rotatable cutting element 300 within the sleeve 330. The locking device 340 may be adjustable or non-adjustable. For example, as shown in FIGS. 3A and 3B, an adjustable locking device 340 may include a spring 342 and pins 344 on both sides of the spring 342 or a spring 342 and balls 345 on both sides of the spring 342. The spring 342 provides adjustability, for example compressibility, such that the balls 345 or pins 344 may compress within the sleeve 330 through the upper region 338 having smaller inner radius $R_1$ and expand to contact the inner surface 331 at the lower region 339 with larger inner radius $R_2$ and lock the rotatable cutting element 300 within the sleeve 330. The spring 342 and balls 345 may be formed as one piece or as separate pieces. Likewise, the spring 342 and pins 344 may be formed as one piece or as separate pieces.

Figure 4B:
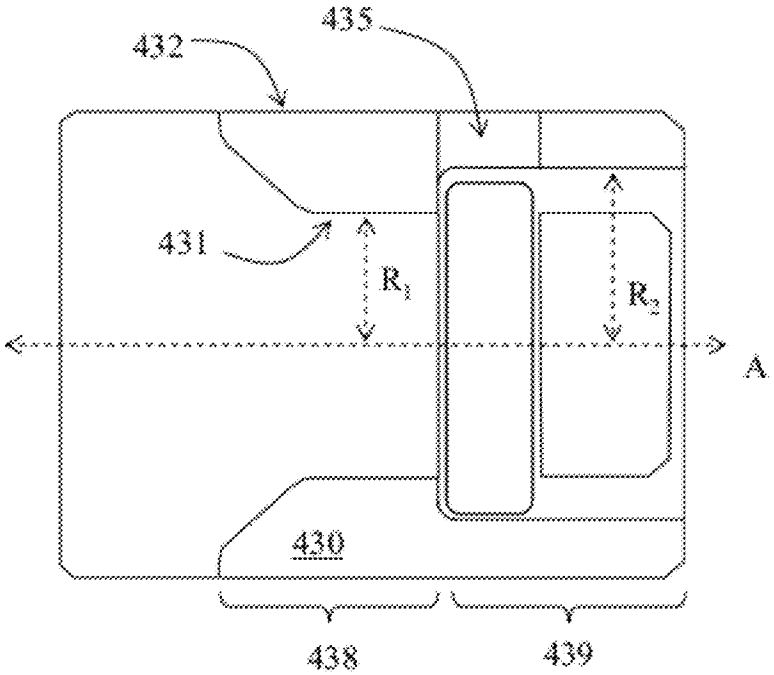
FIGS. 4A and 4B show a perspective view and a cross-sectional view of rotatable cutting elements according to embodiments of the present disclosure.
Figure 4A:
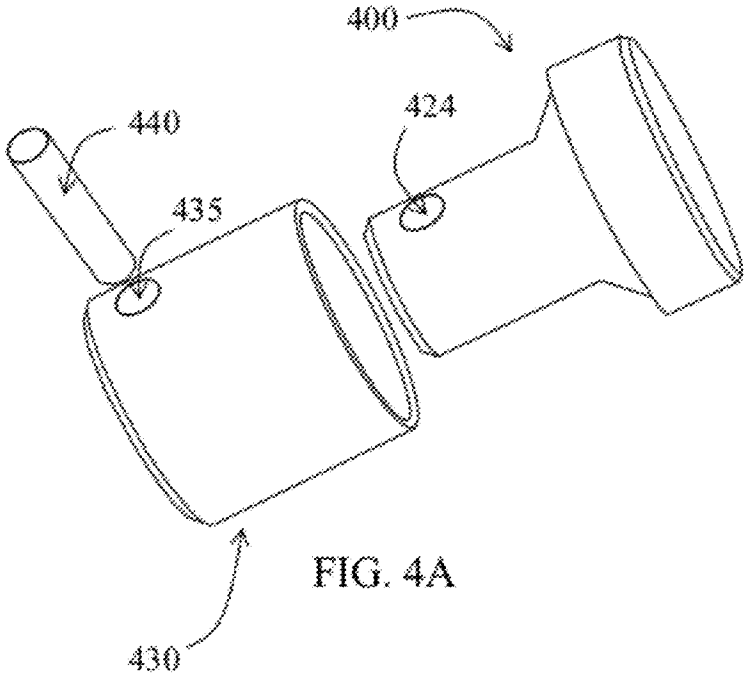

FIGS. 4A and 4B show a perspective view and cross-sectional view of another embodiment of a rotatable cutting element 400 attached to a sleeve 430 using a locking device 440. The rotatable cutting element 400 has an axis of rotation A extending therethrough, a cutting face 410, and a body 420 extending axially downward from the cutting face 410. At least one hole 424 extends from an outer surface 422 of the body 420 toward the axis of rotation A. The rotatable cutting element may be at least partially disposed within a sleeve 430. The sleeve 430 has an outer surface 432, an inner surface 431, and multiple inner radii, including an inner radius $R_1$ of a lesser value at an upper region 438 of the sleeve than an inner radius $R_2$ at a lower region 439 of the sleeve, wherein the inner surface radii are measured from the axis of rotation A of the rotatable cutting element 400.

The rotatable cutting element 400 may be inserted into a sleeve 430 such that the at least one hole 424 is aligned with a sleeve opening 435. A locking device 440 may be inserted through the sleeve opening 435 and into the hole 424. The locking device 440 protrudes from the rotatable cutting element 400 to contact the inner surface 431 of the sleeve 430 as the rotatable cutting element 400 rotates within the sleeve 430. The locking device 440 may be adjustable or non-adjustable. For example, the locking device 440 may be a coiled pin, wherein the pin material may be coiled to have a smaller diameter than the sleeve opening 435 to fit through the sleeve opening 435. Once a compressed coiled pin is inserted through the sleeve opening 435, the coiled pin may partially uncoil to expand to fit within the diameter of the at least one hole 424. Alternatively, the locking device 440 may be a solid pin.

A sleeve according to the present disclosure may be disposed in a cutter pocket of a bit blade such that a sleeve opening is exposed at the top of the blade so that a locking device may be inserted, accessed, and/or removed without removing the entire sleeve from the bit blade. In embodiments of sleeves without access openings, a sleeve may be removed and the rotatable cutting element accessed through the back of the sleeve. Further, in other embodiments discussed below, a sleeve may have a diamond table at the upper region of the sleeve to form a rotatable sleeve cutting element, while an inner support member is secured to a cutting tool to support the rotatable sleeve cutting element.

According to embodiments of the present disclosure, the at least one hole in a rotatable cutting element may be a blind hole (a hole extending partially through the rotatable cutting element, from an outer surface) or a through hole (a hole extending completely through the rotatable cutting element, from an outer surface of the rotatable cutting element to the opposite surface). For example, as shown in FIGS. 3A-4B, a hole 324, 424 may extend completely through a rotatable cutting element 300, 400, thus forming a through hole. In other exemplary embodiments, as shown in FIGS. 5A-5D, a hole 524 may extend partially into a rotatable cutting element 500, thus forming a blind hole. In embodiments having at least one blind hole 524 formed in a rotatable cutting element, as shown in FIGS. 5A-D, a locking device 540 may be inserted into each hole 524, wherein the locking device may be adjustable or non-adjustable. For example, a locking device 540 may include a spring 542 and a ball 545 (shown in FIG. 5A), a spring and a pin 544 (shown in FIGS. 5B and 5C), or a coiled pin 543 (shown in FIG. 5D), to form an adjustable locking device. In other embodiments, the locking device may be non-adjustable.

Further, locking devices of the present disclosure may be inserted into a blind hole formed in a rotatable cutting element while the rotatable cutting element is disposed within a sleeve, or locking devices may be inserted into a blind hole before the rotatable cutting element is disposed within a sleeve. Referring to FIG. 5D, a rotatable cutting element 500 may be inserted within a sleeve 530 such that at least one hole 524 aligns with a sleeve opening 535. A locking device 540 may then be inserted through the sleeve opening 535 and into the hole 524 within the rotatable cutting element 500. Furthermore, in FIG. 5D, the sleeve opening 535 diameter may be bigger than the locking device diameter so that the locking device 540 may fit through the sleeve opening. Alternatively, in embodiments having a coiled pin locking device, the coiled pin may be coiled tightly to fit within the sleeve opening diameter, and once the coiled pin is fit through the sleeve opening diameter, the coiled pin diameter may expand to fit the diameter of the hole in the rotatable cutting element and to prevent the coiled pin from falling out of the sleeve opening. While the sleeve opening in FIG. 5D provides a way to insert a locking device into the rotatable cutting element after the rotatable cutting element has been disposed within the sleeve, a sleeve opening may also or alternatively provide an access point for removing a locking device without removing the rotatable cutting element. For example, as shown in FIG. 5C, a locking device having a pin 544 and a spring 542 may be inserted within a blind hole 524 formed in the rotatable cutting element 500, and the assembly may then be inserted within a sleeve 530. The sleeve opening 535 may provide an access point to the locking device, wherein the pin 544 may be pressed by a tool inserted through the sleeve opening 535, so that the rotatable cutting element 500 and locking device may be pulled out of the sleeve 530 while the sleeve is still attached to the bit.

Figure 5B:
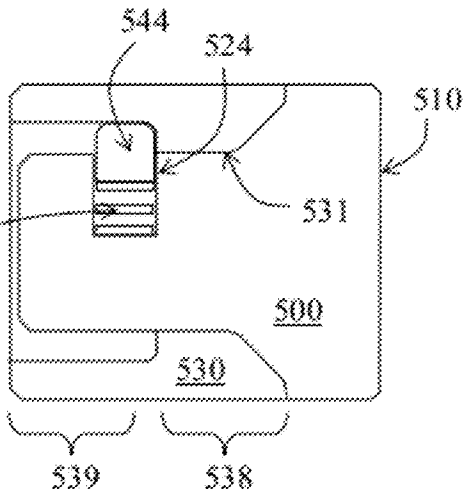
FIGS. 5A-D show cross-sectional views of rotatable cutting elements according to other embodiments of the present disclosure.
Figure 5D:
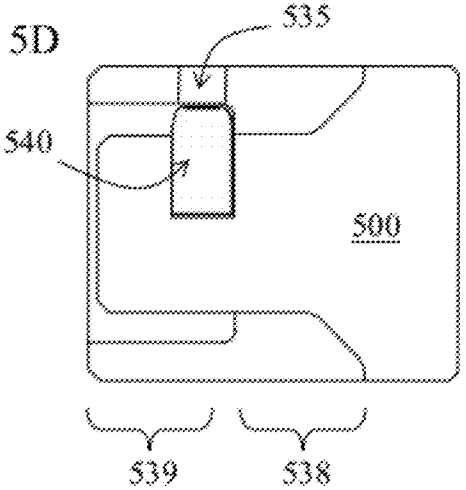
Figure 5A:
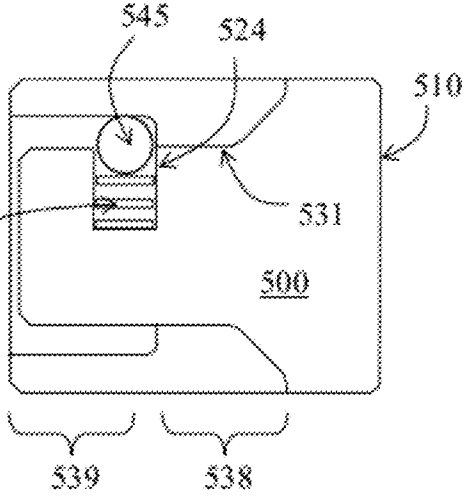
Figure 5C:
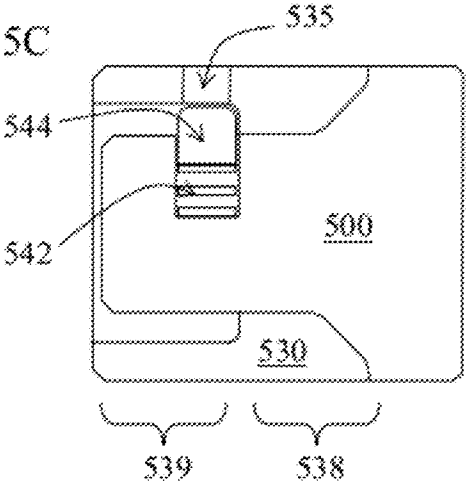

As shown in FIGS. 5A and 5B, a locking device 540 may be first inserted into a hole 524 within the rotatable cutting element 500. The rotatable cutting element 500 and locking device 540 may then be inserted within the sleeve 530 either from an upper region 538 of the sleeve or from a lower region 539 of the sleeve. As used herein, an upper region and a lower region of a sleeve may refer to relative positions of the sleeve, wherein the lower region is at a lower axial position than the upper region. As shown in FIGS. 5A and 5B, the radius of a cutting face 510 may be larger than each of the multiple inner surface radii of the sleeve 530, or at least larger than the first diameter at the upper axial position. In such embodiments, the rotatable cutting element 500 and locking device 540 may be inserted within the sleeve 530 from the upper region 538 of the sleeve, wherein the locking device 540 may be adjustable to compress through the inner surface 531 of the sleeve 530. In the embodiments illustrated in FIGS. 5C and 5D, the radius of the cutting face 510 is also larger than the first diameter at the upper axial position, and so the rotatable cutting element 500 is inserted within the sleeve 530 from the upper region 538 of the sleeve, wherein the locking device 540 is subsequently inserted through the sleeve opening 535 to retain rotatable cutting element 500 within the sleeve 530.

Figure 10D:
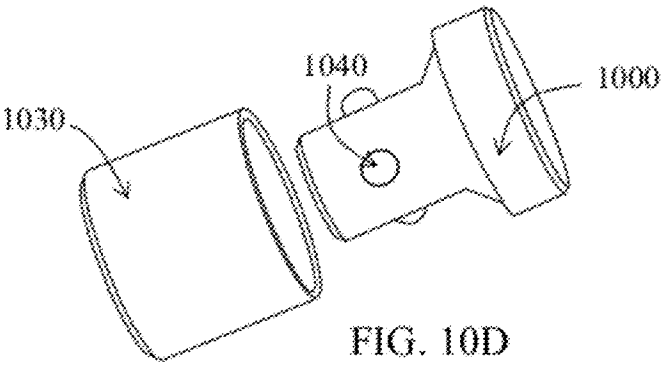
FIGS. 10A-D show cross-sectional views and perspective views of rotatable cutting elements according to embodiments of the present disclosure.
Figure 10B:
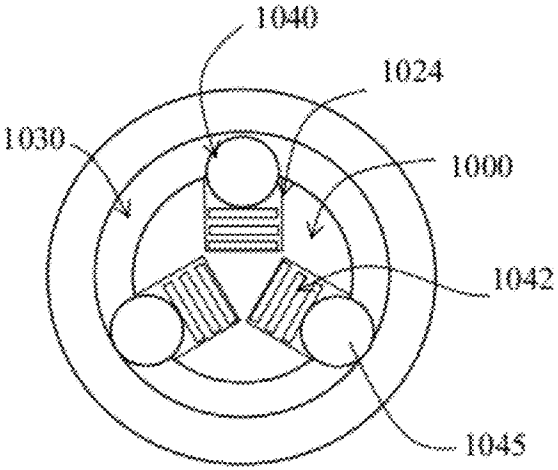
Figure 10C:
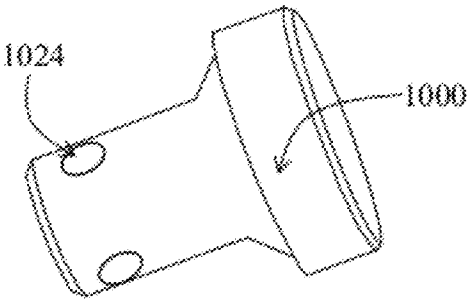
Figure 10A:
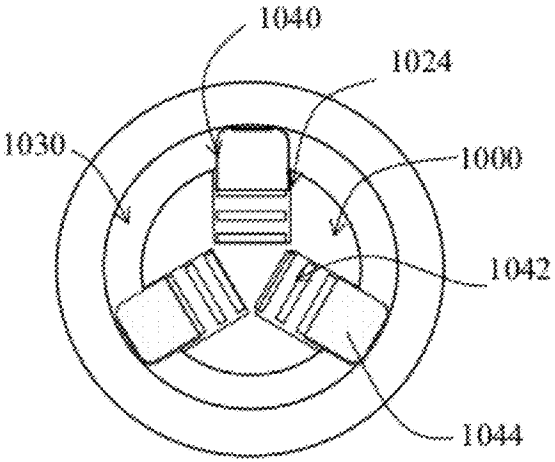

Although the embodiments shown in FIGS. 5A-D show one hole and corresponding locking device in a rotatable cutting element, more than one hole may be formed in a rotatable cutting element and locking device disposed within each hole. For example, FIGS. 10A-B show cross-sectional views and FIGS. 10C-D show perspective views of a rotatable cutting element 1000 having more than one hole 1024 formed therein, wherein the rotatable cutting element is disposed within a sleeve 1030. A locking device 1040 may be disposed within each hole 1024, wherein the locking device may be adjustable or non-adjustable. As shown in FIG. 10A, each locking device 1040 may include a pin 1044 and a spring 1042. As shown in FIG. 10B, each locking device 1040 may include a ball 1045 and a spring 1042. However, other embodiments may include locking devices having other shapes or sizes, wherein the locking device may protrude from the rotatable cutting element to contact the inner surface of a sleeve and retain the rotatable cutting element within the sleeve.

Furthermore, locking devices of the present disclosure may include springs with varying values of compressibility. For example, a spring forming part of a locking device may have a spring constant ranging from 1 lb/in to 50 lb/in. In other embodiments, a spring in a locking device may have a spring constant ranging from 3 lb/in to 20 lb/in.

According to other embodiments of the present disclosure, the cutting face of a rotatable cutting element may have a radius that may fit through the inner surface radii of a sleeve. For example, referring to FIGS. 6A and 6B, a cutting face 610 of a rotatable cutting element 600 may have a radius substantially equal to the smallest radius of a sleeve inner surface 631, so that the rotatable cutting element may fit through the sleeve 630. As used herein, a substantially equal radius includes a sufficient gap to allow the rotatable cutting element 600 to rotate within sleeve 630, which may range, for example, from about 0.003 to 0.030 inches. A locking device, such as a spring 642 and pin 644 (shown in FIG. 6A) or a non-adjustable pin 643 (shown in FIG. 6B) may be inserted into a hole 642 formed in the body of a rotatable cutting element 600, wherein the locking device 640 protrudes from the body of the rotatable cutting element 600. The locking device and rotatable cutting element 600 may then be inserted into the sleeve 630 from the lower region 639 of the sleeve towards the upper region 638 of the sleeve. Alternatively, in some embodiments having an adjustable locking device (such as shown in FIG. 6A), the adjustable locking device may be depressed into the hole formed in the body of the rotatable cutting element as the rotatable cutting element is inserted into the sleeve from the upper region of the sleeve to the lower region. As shown, the inner surface 631 of the sleeves 630 in FIGS. 6A and 6B have multiple radii, including an inner radius $R_1$ of a lesser value at an upper region 638 of the sleeve than an inner radius $R_2$ at a lower region 639 of the sleeve, wherein the inner surface radii are measured from the axis of rotation A of the rotatable cutting element 600. Upon inserting the rotatable cutting element 600 and protruding locking device into the lower region 639 of the sleeve, the locking device 640 may protrude from the rotatable cutting element 600 a distance to rotatably contact the inner radius $R_2$ of the sleeve 630, and prevent the rotatable cutting element 600 from sliding out of the upper region 638 of the sleeve. In particular, while the locking device may protrude to contact a larger inner radius in the lower region of the sleeve, the locking device may be too large to fit through a smaller inner radius in the upper region of the sleeve, thereby retaining the rotatable cutting element within the sleeve. It is also envisioned that any of the locking devices of the present disclosure need not be so large to contact the larger inner radius, so long as it is larger than the smaller inner radius in the upper region of the sleeve.

Figure 6B:
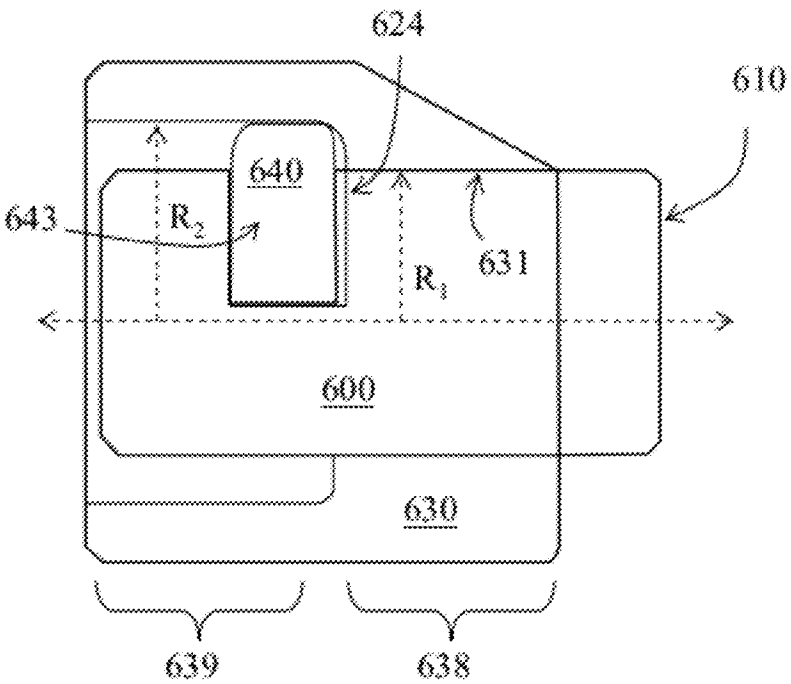
FIGS. 6A and 6B show cross-sectional views of rotatable cutting elements according to other embodiments of the present disclosure.
Figure 6A:
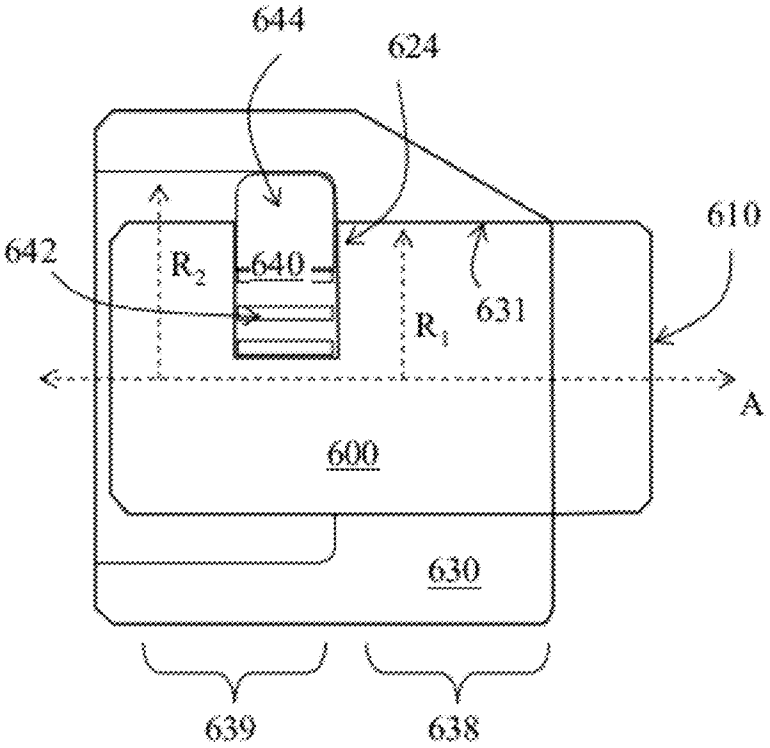
Figure 7A:
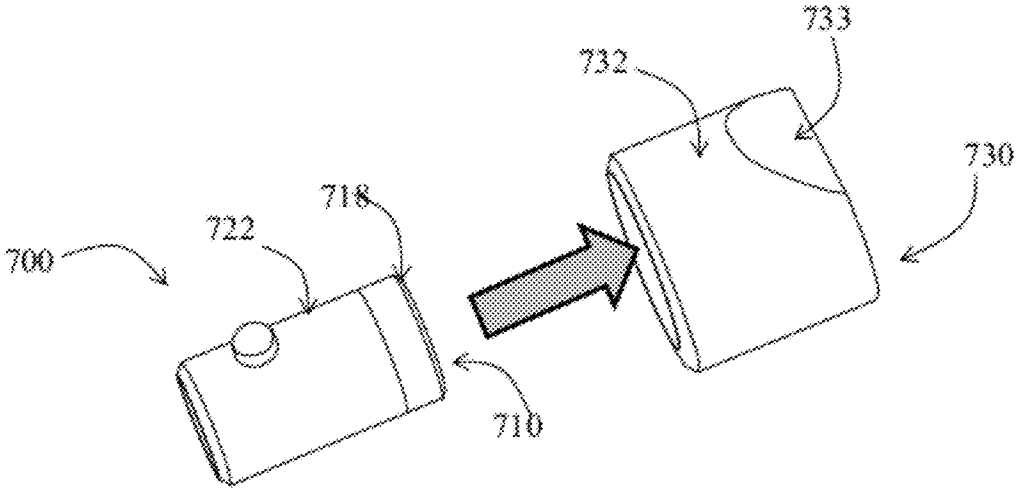
FIGS. 7A-C show perspective views of rotatable cutting elements according to embodiments of the present disclosure.
Figure 7C:
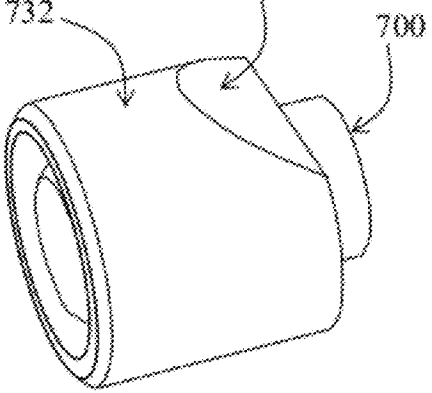
Figure 7B:
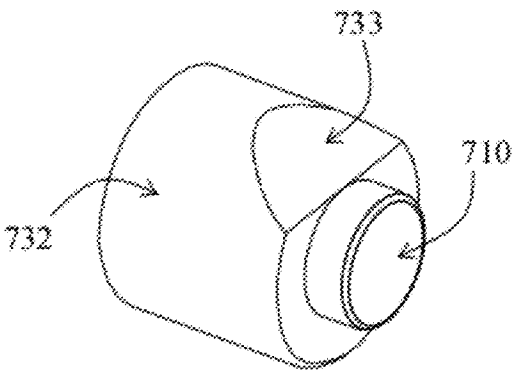

FIGS. 7A-C show a perspective view of the embodiments shown in FIGS. 6A and 6B. In particular, a rotatable cutting element 700 may be disposed within a sleeve 730, wherein the radius of the cutting face 710 of the rotatable cutting element 700 is slightly smaller than the inner surface radii of the sleeve 730, such that the rotatable cutting element 700 may fit through the sleeve 730. As shown, the outer surface 722 of the rotatable cutting element 700 and the cutting face 710 may intersect to form a cutting edge 718. In embodiments having a rotatable cutting element 700 with a cutting face 710 radius that is smaller than the radius of the outer surface 732 of the sleeve 730, the sleeve 730 may have a chamfer 733, which may be positioned at the top side of a blade so that the cutting edge may contact and cut the formation surface when installed on a bit or other cutting tool.

The cutting face 710 may be formed of diamond or other ultra-hard material. Further, once a rotatable cutting element 700 is disposed within a sleeve 730, a diamond or ultrahard material cutting surface may be adjacent to an upper region of the sleeve, and assembly may be disposed on a blade so that the cutting surface contacts and cuts a working surface. For example, a diamond cutting face may extend a thickness of about 0.06 inches to about 0.15 inches to form a diamond cutting table. In other embodiments, a rotatable cutting element may have a diamond or other ultrahard material table having a thickness ranging from about 0.05 to 0.15 inches.

As described above, rotatable cutting elements of the present disclosure may be assembled with locking devices and the assembly inserted into a sleeve, or rotatable cutting elements may be inserted into a sleeve and the at least one locking device added after inserting the rotatable cutting element into the sleeve. Further, a rotatable cutting element of the present disclosure may be inserted into a sleeve from the lower region of the sleeve or from the upper region of the sleeve. However, a rotatable cutting element may be disposed within a sleeve by other means. For example, according to other embodiments of the present disclosure, a rotatable cutting element may be inserted into a sleeve from both the lower region of the sleeve and upper region of the sleeve. Referring to FIG. 8A, a rotatable cutting element 800 may be screwed into a rotatable base 802 disposed within a sleeve 830. As shown, the rotatable base 802 may have a diameter that fits within a larger diameter 836 of the sleeve inner surface 831, but does not fit within a smaller diameter 834 of the sleeve inner surface 831. Thus, the rotatable base 802 may be inserted into the sleeve 830 through the larger lower region 839 of the sleeve, and the rotatable cutting element 800 may be inserted through the upper region 838 of the sleeve and screwed into the rotatable base 802. A hole 824 may be formed in the rotatable base 802 and aligned with an access hole 835 formed in the sleeve 830 so that a locking tool (not shown) may be inserted through the access hole 835 and into the rotatable base hole 824 to hold the rotatable base 802 as the rotatable cutting element 800 is screwed into the rotatable base 802. Once the rotatable cutting element 800 is screwed into the rotatable base 802, the locking tool may be removed from the access hole 835 and rotatable base hole 824, and both the rotatable cutting element 800 and rotatable base 802 may rotate within the sleeve 830. Rotatable base 802 may be joined with rotatable cutting element 800 by mechanical means (such as a thread) or by brazing or similar means to collar lock the two pieces together.

Figure 8B:
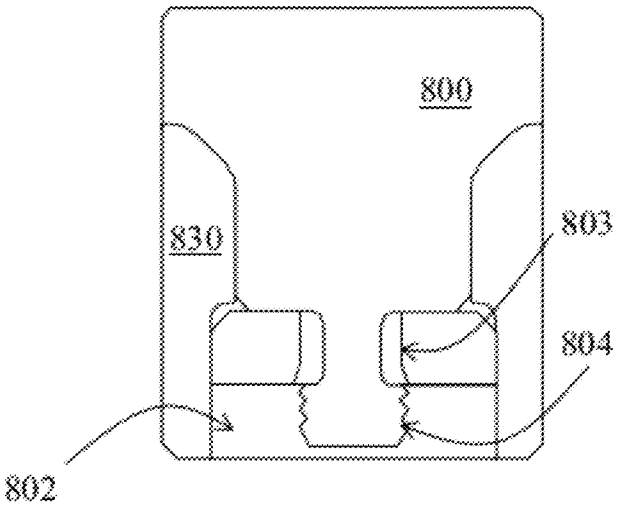
FIGS. 8A and 8B show cross-sectional views of rotatable cutting elements according to yet other embodiments of the present disclosure.
Figure 8A:
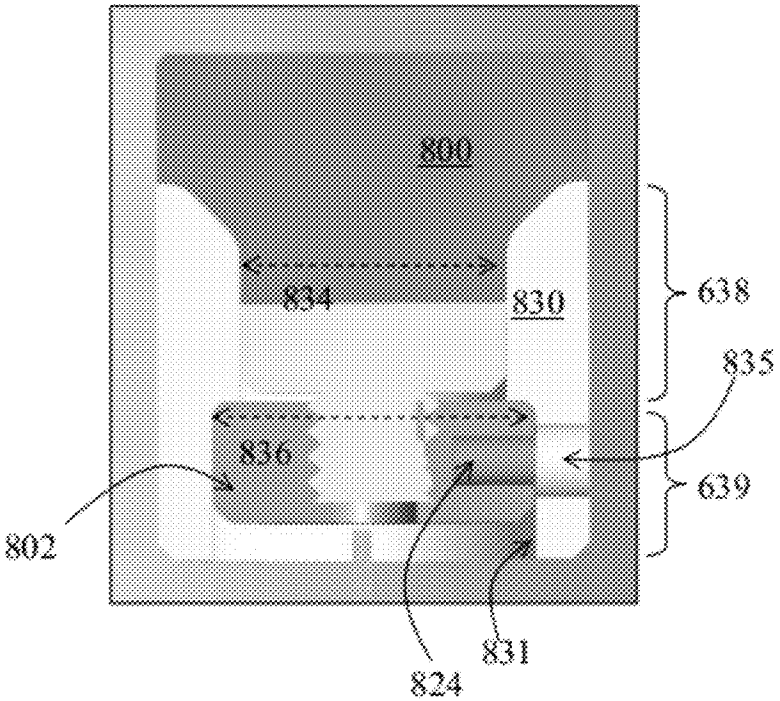

Referring now to FIG. 8B, a rotatable cutting element 800 may be threaded to a rotatable base 802, wherein the rotatable cutting element 800 has a deformable region 803 and a threaded region 804. In particular, the rotatable base 802 may be placed inside a sleeve 830. The sleeve 830 may then be brazed or otherwise attached to the bit body. The rotatable cutting element 800 may then be inserted into the sleeve 830 by screwing the rotatable cutting element 800 into the rotatable base 802 having corresponding threads. The threaded region 804 of the rotatable cutting element 800 may be threaded into the rotatable base 802 so that the deformable region 803 of the rotatable cutting element 800 may also be threaded within the rotatable base 802. The threads in the rotatable base 802 may bite into the deformable region 803 and thus prevent the rotatable cutting element from coming out of the sleeve 830. The deformable region 803 may be made of plastic, Teflon, or rubber, for example.

Figure 9B:
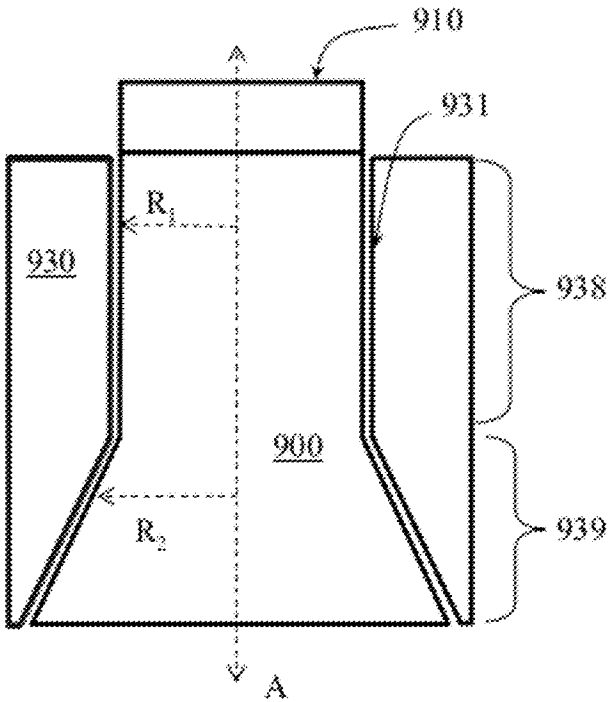
FIGS. 9A-C show cross-sectional views of rotatable cutting elements according to some embodiments of the present disclosure.
Figure 9A:
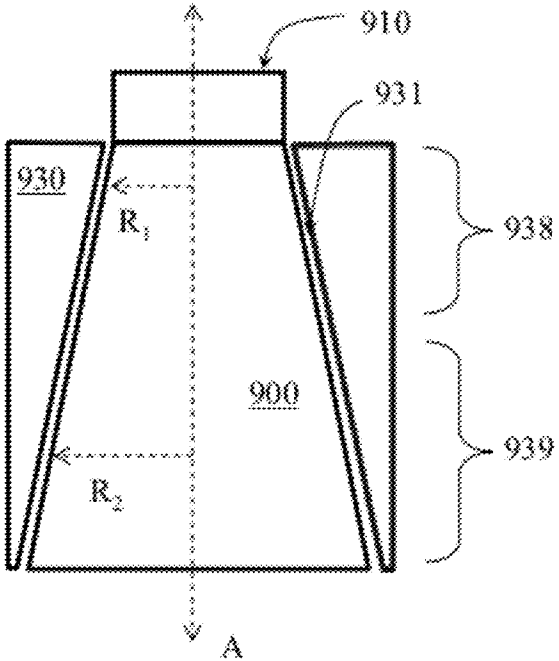
Figure 9C:
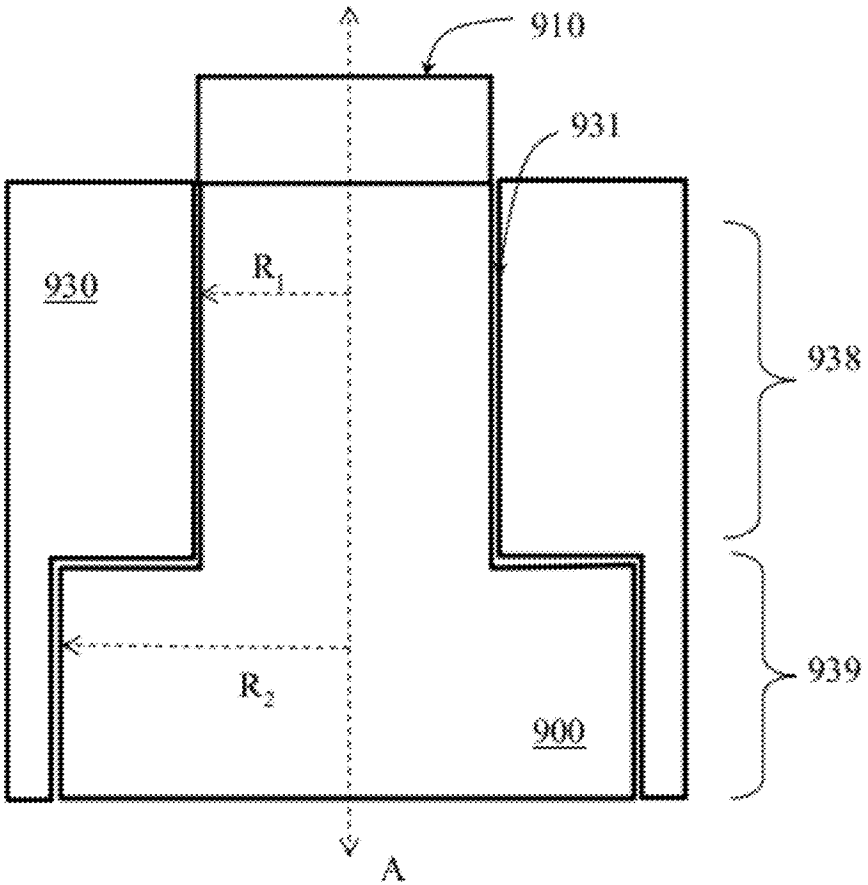

According to some embodiments, a rotatable cutting element may be retained within a sleeve without the use of a locking device. Exemplary embodiments of cutting elements having a rotatable cutting element retained in a sleeve without the use of a locking device are shown in FIGS. 9A-C, wherein a diameter of a rotatable cutting element is larger at an axially lower position than the diameter at an axially upper position. As shown in FIGS. 9A-C, a cutting element may have a sleeve 930 with an inner radius $R_1$ of a lesser value at an upper region 938 of the sleeve 930 than an inner radius $R_2$ at a lower region 939 of the sleeve 930. A rotatable cutting element 900 having an axis of rotation A extending therethrough may be at least partially disposed within the sleeve 930. The rotatable cutting element 900 has a diamond cutting face 910 adjacent the uppermost portion of the sleeve 930, wherein at least a portion of the rotatable cutting element 900 has an outer radius greater than the inner radius $R_1$ of the upper region 938 of the sleeve, and wherein the portion of the rotatable cutting element is at a lower longitudinal position than the inner radius $R_1$. As shown in FIG. 9A, the inner surface 931 of the sleeve 930 may have a continuously increasing radius extending longitudinally from the upper region 938 to the lower region 939. As shown in FIG. 9B, the inner surface 931 of the sleeve 930 may have a constant inner radius at a portion of the sleeve and at another portion, the sleeve 930 may have a continuously increasing radius extending in a lower axial position. In other embodiments, the sleeve 930 may have two or more portions having constant inner radii. For example, as shown in FIG. 9C, a sleeve 930 may have a first constant inner radius $R_1$ at an upper region 938, and a second constant inner radius $R_2$ at a lower region 939, wherein the second constant inner radius $R_2$ at the lower region is larger than the first constant inner radius.

The cutting elements of the present disclosure may be attached to a drill bit by attaching a sleeve to a bit cutter pocket by methods known in the art, such as by brazing. In particular, a drill bit has a bit body, a plurality of blades extending from the bit body, wherein each blade has a leading face, a trailing face, and a top side, and a plurality of cutter pockets disposed in the plurality of blades. The cutter pockets may be formed in the top side of a blade, at the leading face, so that the cutting elements may contact and cut the working surface once disposed in the cutter pockets. A sleeve of a cutting element according to embodiments disclosed herein may be attached to at least one cutter pocket with or without a rotatable cutting element disposed therein. The sleeve may be attached to a bit body using a brazing process known in the art. Alternatively, in other embodiments of the present disclosure, a sleeve may be infiltrated or cast directly into the bit body during an infiltration or sintering process. The sleeve may have a first inner diameter and a second inner diameter, wherein the second inner diameter is larger than the first inner diameter.

A rotatable cutting element (inserted within the sleeve either before or after attachment to a cutter pocket), having an axis of rotation extending therethrough, may have a cutting face, a body extending downwardly from the cutting face, an outer surface, and a cutting edge formed at the intersection of the cutting face and the outer surface. At least one hole may be formed in the rotatable cutting element body, extending from an outer surface of the body toward the axis of rotation, and a locking device may be disposed in each hole. The locking device may protrude from the hole to contact the second inner diameter of the sleeve, thereby retaining the rotatable cutting element within the sleeve. Alternatively, the features of the rotatable cutting elements disclosed herein may be used on a cutting element that is mechanically attached to the sleeve such that it does not rotate within the sleeve.

A sleeve of the present disclosure may further have an access hole, or an opening, wherein a locking device may be inserted into a hole within a rotatable cutting element through the sleeve opening (such as in embodiments where the rotatable cutting element is inserted within the sleeve after the sleeve is attached to a cutter pocket), and/or wherein a locking device may be removed through the opening (e.g., to replace the rotatable cutting element). In such embodiments, the access hole, or opening, may be positioned facing the top side of a blade so that the locking device may be accessed without removing the sleeve.

Figure 11:
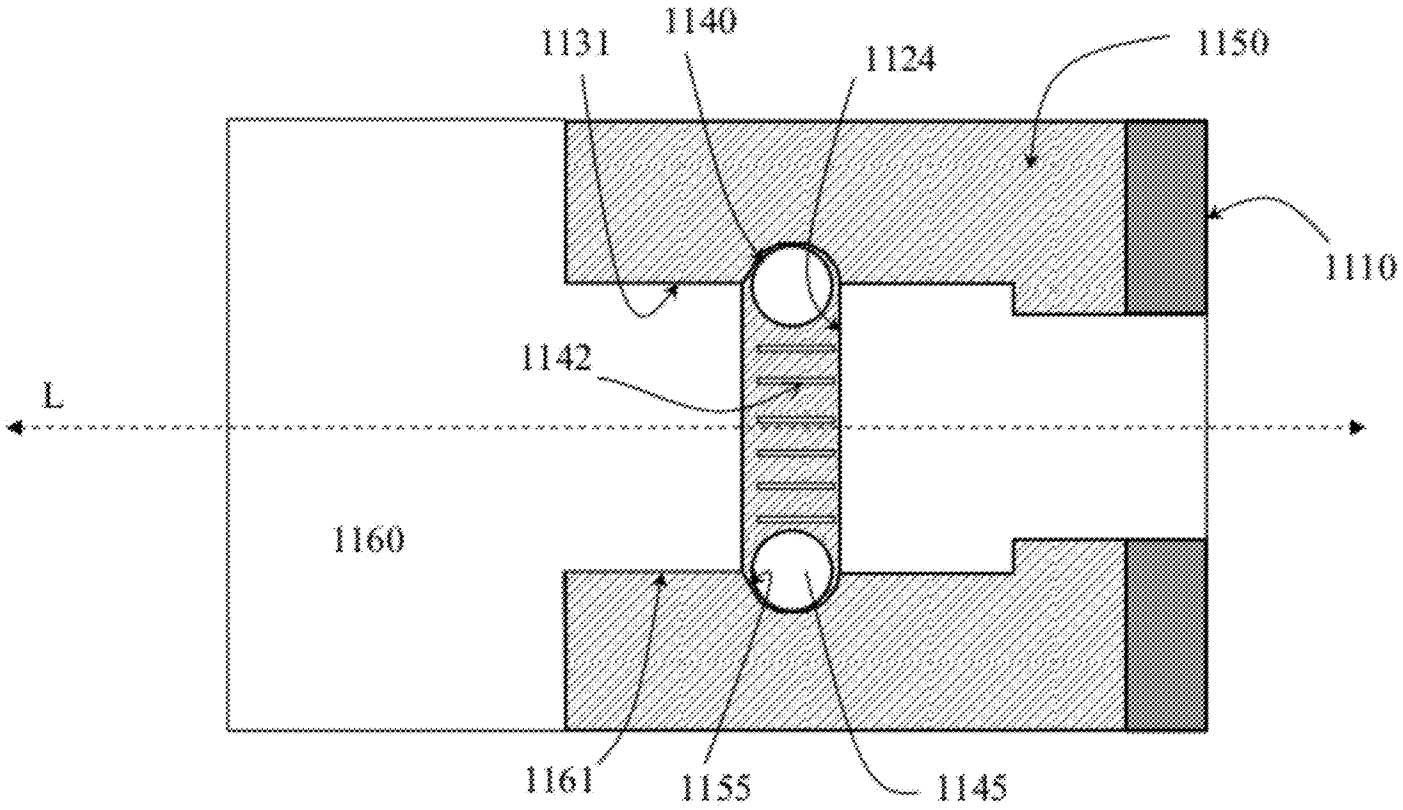
FIG. 11 shows a cross-sectional view of a rotatable cutting element according to embodiments of the present disclosure.

In some embodiments, a sleeve having a cutting face may be rotatably mounted to an inner support member to form a rotatable sleeve cutting element. For example, referring to FIG. 11, a rotatable sleeve cutting element 1150 is rotatably mounted to an inner support member 1160. The inner support member 1160 has a longitudinal axis L extending therethrough and at least one hole 1124 extending from an outer surface 1161 of the inner support member 1160 toward the longitudinal axis L. The rotatable sleeve cutting element 1150 has a cutting face 1110 adjacent the uppermost portion of the rotatable sleeve cutting element. The cutting face may include an ultrahard material, for example, a diamond table. As shown in FIG. 11, a circumferential groove 1155 is formed within an inner surface 1131 of the rotatable sleeve cutting element 1150. A locking device 1140 is disposed in the hole 1124 of the inner support member 1160, wherein the locking device 1140 protrudes from the hole 1124 to contact the circumferential groove 1155, thereby retaining the rotatable sleeve cutting element 1150 to the inner support member 1160. As described above, a locking device may include a spring and ball assembly, or a spring and pin assembly, for example. Further, embodiments having a rotatable sleeve cutting element may have a portion of the inner support member exposed at the cutting face, or alternatively, the cutting face of the rotatable sleeve cutting element may cover the inner support member.

Further, rotatable cutting elements may be machined from one piece, or may be made from more than one piece. For example, in embodiments having a diamond cutting face, a rotatable cutting element may be formed from a carbide substrate and a diamond table formed on or attached to an upper surface of the carbide substrate, such as by means known in the art. Alternatively, rotatable cutting elements of the present disclosure may be formed from more than one piece of the same material.

Each of the embodiments described herein may have at least one ultrahard material included therein. Such ultra hard materials may include a conventional polycrystalline diamond table (a table of interconnected diamond particles having interstitial spaces therebetween in which a metal component (such as a metal catalyst) may reside, a thermally stable diamond layer (i.e., having a thermal stability greater than that of conventional polycrystalline diamond, 750° C.) formed, for example, by removing substantially all metal from the interstitial spaces between interconnected diamond particles or from a diamond/silicon carbide composite, or other ultra hard material such as a cubic boron nitride. Further, in particular embodiments, the inner rotatable cutting element may be formed entirely of ultrahard material(s), but the element may include a plurality of diamond grades used, for example, to form a gradient structure (with a smooth or non-smooth transition between the grades). In a particular embodiment, a first diamond grade having smaller particle sizes and/or a higher diamond density may be used to form the upper portion of the inner rotatable cutting element (that forms the cutting edge when installed on a bit or other tool), while a second diamond grade having larger particle sizes and/or a higher metal content may be used to form the lower, non-cutting portion of the cutting element. Further, it is also within the scope of the present disclosure that more than two diamond grades may be used.

As known in the art, thermally stable diamond may be formed in various manners. A typical polycrystalline diamond layer includes individual diamond "crystals" that are interconnected. The individual diamond crystals thus form a lattice structure. A metal catalyst, such as cobalt, may be used to promote recrystallization of the diamond particles and formation of the lattice structure. Thus, cobalt particles are typically found within the interstitial spaces in the diamond lattice structure. Cobalt has a significantly different coefficient of thermal expansion as compared to diamond. Therefore, upon heating of a diamond table, the cobalt and the diamond lattice will expand at different rates, causing cracks to form in the lattice structure and resulting in deterioration of the diamond table.

To obviate this problem, strong acids may be used to "leach" the cobalt from a polycrystalline diamond lattice structure (either a thin volume or entire tablet) to at least reduce the damage experienced from heating diamond-cobalt composite at different rates upon heating. Examples of "leaching" processes can be found, for example, in U.S. Pat. Nos. 4,288,248 and 4,104,344. Briefly, a strong acid, typically hydrofluoric acid or combinations of several strong acids may be used to treat the diamond table, removing at least a portion of the co-catalyst from the PDC composite. Suitable acids include nitric acid, hydrofluoric acid, hydrochloric acid, sulfuric acid, phosphoric acid, or perchloric acid, or combinations of these acids. In addition, caustics, such as sodium hydroxide and potassium hydroxide, have been used to the carbide industry to digest metallic elements from carbide composites. In addition, other acidic and basic leaching agents may be used as desired. Those having ordinary skill in the art will appreciate that the molarity of the leaching agent may be adjusted depending on the time desired to leach, concerns about hazards, etc.

By leaching out the cobalt, thermally stable polycrystalline (TSP) diamond may be formed. In certain embodiments, only a select portion of a diamond composite is leached, in order to gain thermal stability without losing impact resistance. As used herein, the term TSP includes both of the above (i.e., partially and completely leached) compounds. Interstitial volumes remaining after leaching may be reduced by either furthering consolidation or by filling the volume with a secondary material, such by processes known in the art and described in U.S. Pat. No. 5,127,923, which is herein incorporated by reference in its entirety.

Alternatively, TSP may be formed by forming the diamond layer in a press using a binder other than cobalt, one such as silicon, which has a coefficient of thermal expansion more similar to that of diamond than cobalt has. During the manufacturing process, a large portion, 80 to 100 volume percent, of the silicon reacts with the diamond lattice to form silicon carbide which also has a thermal expansion similar to diamond. Upon heating, any remaining silicon, silicon carbide, and the diamond lattice will expand at more similar rates as compared to rates of expansion for cobalt and diamond, resulting in a more thermally stable layer. PDC cutters having a TSP cutting layer have relatively low wear rates, even as cutter temperatures reach 1200° C. However, one of ordinary skill in the art would recognize that a thermally stable diamond layer may be formed by other methods known in the art, including, for example, by altering processing conditions in the formation of the diamond layer.

The substrate on which the cutting face is disposed may be formed of a variety of hard or ultra hard particles. In one embodiment, the substrate may be formed from a suitable material such as tungsten carbide, tantalum carbide, or titanium carbide. Additionally, various binding metals may be included in the substrate, such as cobalt, nickel, iron, metal alloys, or mixtures thereof. In the substrate, the metal carbide grains are supported within the metallic binder, such as cobalt. Additionally, the substrate may be formed of a sintered tungsten carbide composite structure. It is well known that various metal carbide compositions and binders may be used, in addition to tungsten carbide and cobalt. Thus, references to the use of tungsten carbide and cobalt are for illustrative purposes only, and no limitation on the type substrate or binder used is intended. In another embodiment, the substrate may also be formed from a diamond ultra hard material such as polycrystalline diamond and thermally stable diamond. While the illustrated embodiments show the cutting face and substrate as two distinct pieces, one of skill in the art should appreciate that it is within the scope of the present disclosure the cutting face and substrate are integral, identical compositions. In such an embodiment, it may be preferable to have a single diamond composite forming the cutting face and substrate or distinct layers.

The outer sleeve may be formed from a variety of materials. In one embodiment, the outer sleeve may be formed of a suitable material such as tungsten carbide, tantalum carbide, or titanium carbide. Additionally, various binding metals may be included in the outer support element, such as cobalt, nickel, iron, metal alloys, or mixtures thereof, such that the metal carbide grains are supported within the metallic binder. In a particular embodiment, the outer support element is a cemented tungsten carbide with a cobalt content ranging from 6 to 13 percent. It is also within the scope of the present disclosure that the outer sleeve (including a back retention mechanism) may also include more lubricious materials to reduce the coefficient of friction. The sleeve may be formed of such materials in their entirely or have a portions thereof (such as the inner surface of the upper region) including such lubricious materials. For example, the sleeve may include diamond, diamond-like coatings, or other solid film lubricant.

In other embodiments, the outer sleeve may be formed of alloy steels, nickel-based alloys, and cobalt-based alloys. One of ordinary skill in the art would also recognize that cutting element components may be coated with a hardfacing material for increased erosion protection. Such coatings may be applied by various techniques known in the art such as, for example, detonation gun (d-gun) and spray-and-fuse techniques.

The cutting elements of the present disclosure may be incorporated in various types of cutting tools, including for example, as cutters in fixed cutter bits or as inserts in roller cone bits. Bits having the cutting elements of the present disclosure may include a single rotatable cutting element with the remaining cutting elements being conventional cutting elements, all cutting elements being rotatable, or any combination therebetween of rotatable and conventional cutting elements.

In some embodiments, the placement of the cutting elements on the blade of a fixed cutter bit or cone of a roller cone bit may be selected such that the rotatable cutting elements are placed in areas experiencing the greatest wear. For example, in a particular embodiment, rotatable cutting elements may be placed on the shoulder or nose area of a fixed cutter bit. Additionally, one of ordinary skill in the art would recognize that there exists no limitation on the sizes of the cutting elements of the present disclosure. For example, in various embodiments, the cutting elements may be formed in sizes including, but not limited to, 9 mm, 13 mm, 16 mm, and 19 mm.

Further, one of ordinary skill in the art would also appreciate that any of the design modifications as described above, including, for example, side rake, back rake, variations in geometry, surface alteration/etching, seals, bearings, material compositions, etc, may be included in various combinations not limited to those described above in the cutting elements of the present disclosure. In one embodiment, a cutter may have a side rake ranging from 0 to ±45 degrees. In another embodiment, a cutter may have a back rake ranging from about 5 to 35 degrees.

A cutter may be positioned on a blade with a selected back rake to assist in removing drill cuttings and increasing rate of penetration. A cutter disposed on a drill bit with side rake may be forced forward in a radial and tangential direction when the bit rotates. In some embodiments because the radial direction may assist the movement of inner rotatable cutting element relative to outer support element, such rotation may allow greater drill cuttings removal and provide an improved rate of penetration. One of ordinary skill in the art will realize that any back rake and side rake combination may be used with the cutting elements of the present disclosure to enhance rotatability and/or improve drilling efficiency.

As a cutting element contacts formation, the rotating motion of the cutting element may be continuous or discontinuous. For example, when the cutting element is mounted with a determined side rake and/or back rake, the cutting force may be generally pointed in one direction. Providing a directional cutting force may allow the cutting element to have a continuous rotating motion, further enhancing drilling efficiency.

However, according to other embodiments, one or more of rotatable cutting elements disclosed above can be altered to be mechanically fixed to the sleeve, thus forming a fixed cutter. For example, in embodiments modified to be mechanically fixed to a sleeve, the inner surface of the sleeve may have a surface geometry configured to correspond with and retain the at least one locking device disposed in the cutting element such that the cutting element is not free to rotate about its axis.

Advantageously, embodiments of the present disclosure may allow a rotatable cutting element to be mounted to a drill bit having conventional cutter pockets formed therein, as well as provide more convenient processes of removing and replacing worn rotatable cutting elements. By using locking devices having adjustable features, the present disclosure may also provide a way of inserting rotatable cutting elements into a sleeve without detaching the sleeve from a bit body. Additionally, the present disclosure may also advantageously provide a way of including rotatable cutting elements within cutter pockets having the same geometry as conventional cutter pockets.

Rotatable cutting elements may avoid the high temperatures generated by typical fixed cutters. Because the cutting surface of prior art cutting elements is constantly contacting formation at a fixed spot, a wear flat can quickly form and thus induce frictional heat. The heat may build-up and cause failure of the cutting element due to thermal mis-match between diamond and catalyst, as discussed above. Embodiments in accordance with the present invention may avoid this heat build-up as the edge contacting the formation changes. The lower temperatures at the edge of the cutting elements may decrease fracture potential, thereby extending the functional life of the cutting element. By decreasing the thermal and mechanical load experienced by the cutting surface of the cutting element, cutting element life may be increase, thereby allowing more efficient drilling.

Further, rotation of a rotatable portion of the cutting element may allow a cutting surface to cut formation using the entire outer edge of the cutting surface, rather than the same section of the outer edge, as provided by the prior art. The entire edge of the cutting element may contact the formation, generating more uniform cutting element edge wear, thereby preventing for formation of a local wear flat area. Because the edge wear is more uniform, the cutting element may not wear as quickly, thereby having a longer downhole life, and thus increasing the overall efficiency of the drilling operation.

Additionally, because the edge of the cutting element contacting the formation changes as the rotatable cutting portion of the cutting element rotates, the cutting edge may remain sharp. The sharp cutting edge may increase the rate of penetration while drilling formation, thereby increasing the efficiency of the drilling operation. Further, as the rotatable portion of the cutting element rotates, a hydraulic force may be applied to the cutting surface to cool and clean the surface of the cutting element.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A cutting element, comprising:

a sleeve, comprising:

a first inner diameter; and a second inner diameter, wherein the second inner diameter is larger than the first inner diameter and located at a lower axial position than the first inner diameter; and a rotatable cutting element having an axis of rotation extending therethrough, the rotatable cutting element at least partially disposed within the sleeve, wherein the rotatable cutting element comprises:

a cutting face and a body extending axially downward from the cutting face;

at least one hole, which does not extend around the entire periphery of the rotatable cutting element, extending from an outer surface of the body toward the axis of rotation; and a locking device disposed in each hole;

wherein the locking device protrudes from the hole to contact the second inner diameter of the sleeve, thereby retaining the rotatable cutting element within the sleeve.

2. The cutting element of claim 1, wherein the locking device comprises at least one spring and at least one ball, wherein the at least one spring is disposed within the at least one hole and the at least one ball contacts the second inner diameter.

3. The cutting element of claim 1, wherein the locking device comprises at least one spring and at least one pin, wherein the at least one spring is disposed within the at least one hole and the at least one pin contacts the second inner diameter.

4. The cutting element of claim 1, wherein the locking device comprises a coiled pin or a solid pin.

5. The cutting element of claim 1, wherein the at least one hole comprises at least one blind hole.

6. The cutting element of claim 1, wherein the at least one hole comprises at least one through hole having two openings.

7. The cutting element of claim 6, wherein one spring is disposed in the through hole and two balls are disposed in the two openings such that the two balls contact the second inner diameter.

8. The cutting element of claim 6, wherein one spring is disposed in the through hole and two pins are disposed in the two openings such that the two pins contact the second inner diameter.

9. The cutting element of claim 1, wherein a portion of the body has a smaller radius than the cutting face radius.

10. The cutting element of claim 9, wherein the radius of the cutting face is equal to the radius of an outer surface of the sleeve.

11. The cutting element of claim 1, wherein the sleeve is attached to a drill bit body.

12. The cutting element of claim 1, wherein the rotatable cutting element is formed of more than one piece.

13. A method of forming a drill bit, comprising:

providing a drill bit comprising:

a bit body;

a plurality of blades extending from the bit body; and a plurality of cutter pockets disposed in the plurality of blades;

attaching a sleeve to at least one cutter pocket, the sleeve comprising:

a first inner diameter; and a second inner diameter, wherein the second inner diameter is larger than the first inner diameter and is located at a lower axial position than the first inner diameter; and inserting a rotatable cutting element having an axis of rotation extending therethrough into the sleeve, the rotatable cutting element comprising:

a cutting face and a body extending axially downward from the cutting face;

at least one hole, which does not extend around the entire periphery of the rotatable cutting element, extending from an outer surface of the body toward the axis of rotation; and a locking device disposed in each hole;

wherein the locking device protrudes from the hole to contact the second inner diameter of the sleeve, thereby retaining the rotatable cutting element within the sleeve.

14. The method of claim 13, wherein the sleeve is brazed into the at least one cutter pocket.

15. The method of claim 13, wherein the sleeve is infiltrated into the at least one cutter pocket.

16. The method of claim 13, wherein the locking device comprises at least one spring and at least one ball, wherein the at least one spring is disposed within the at least one hole and the at least one ball contacts the second inner diameter.

17. The method of claim 13, wherein the locking device comprises at least one spring and at least one pin, wherein the at least one spring is disposed within the at least one hole and the at least one pin contacts the second inner diameter.

18. A cutting element, comprising:

a sleeve having a first inner radius at a first end of the sleeve and a second inner radius at a second end of the sleeve, the first inner radius being smaller than the second inner radius, and at least a portion of the sleeve including a continuously increasing inner radii from the first inner radius to the second inner radius; and a rotatable cutting element having an axis of rotation extending therethrough, the rotatable cutting element at least partially disposed within the sleeve, the rotatable cutting element comprising:

a cutting face adjacent the first end of the sleeve, at least a portion of the rotatable cutting element opposite the cutting face having an outer radius greater than the inner radius of the first end of the sleeve.

19. The cutting element of claim 18, wherein the sleeve has continuously increasing inner radii from the upper region of the sleeve to the lower region of the sleeve.

20. The cutting element of claim 18, wherein at least a portion of the sleeve has a constant inner radius value.

21. The cutting element of claim 18, wherein the rotatable cutting element comprises more than one piece.

22. The cutting element of claim 18, wherein the rotatable cutting element is formed from a single piece.

23. The cutting element of claim 18, wherein the rotatable cutting element further comprises a rotatable base having the outer radius greater than the inner radius of the upper region of the sleeve.

24. A cutting element, comprising:

an inner support member having a longitudinal axis extending therethrough;

at least one hole extending from an outer surface of the inner support member toward the longitudinal axis; and a locking device disposed in each hole; and a rotatable sleeve cutting element rotatably mounted on the inner support member, the rotatable sleeve cutting element comprising:

a cutting face adjacent the uppermost portion of the rotatable sleeve cutting element; and a circumferential groove formed within an inner surface of the rotatable sleeve cutting element;

wherein the at least one hole comprises at least one through hole having two openings or at least one blind hole, and wherein the locking device protrudes from the hole to contact the circumferential groove, thereby retaining the rotatable sleeve cutting element on the inner support member.

25. The cutting element of claim 24, wherein the locking device comprises at least one spring and at least one ball, wherein the at least one spring is disposed within the at least one hole and the at least one ball contacts the circumferential groove.

26. The cutting element of claim 24, wherein the locking device comprises at least one spring and at least one pin, wherein the at least one spring is disposed within the at least one hole and the at least one pin contacts the circumferential groove.

* * * * *